US011369007B2

(12) United States Patent
Coursey et al.

(10) Patent No.: US 11,369,007 B2
(45) Date of Patent: Jun. 21, 2022

(54) SYSTEMS AND METHODS USING EXTERNAL HEATER SYSTEMS IN MICROFLUIDIC DEVICES

(71) Applicants: Johnathan S. Coursey, Rockville, MD (US); Kenton C. Hasson, Germantown, MD (US)

(72) Inventors: Johnathan S. Coursey, Rockville, MD (US); Kenton C. Hasson, Germantown, MD (US)

(73) Assignee: Canon U.S.A., Inc., Melville, NY (US)

( * ) Notice: Subject to any disclaimer, the term of this patent is extended or adjusted under 35 U.S.C. 154(b) by 0 days.

(21) Appl. No.: 15/412,983

(22) Filed: Jan. 23, 2017

(65) Prior Publication Data

US 2017/0325288 A1 Nov. 9, 2017

Related U.S. Application Data

(62) Division of application No. 13/474,523, filed on May 17, 2012, now Pat. No. 9,554,422.
(Continued)

(51) Int. Cl.
*H05B 1/02* (2006.01)
*F25B 29/00* (2006.01)
(Continued)

(52) U.S. Cl.
CPC ..... *H05B 1/0297* (2013.01); *B01L 3/5027* (2013.01); *B01L 7/52* (2013.01); *F25B 29/00* (2013.01); *B01L 2200/147* (2013.01); *B01L 2200/148* (2013.01); *B01L 2300/0816* (2013.01); *B01L 2300/1827* (2013.01);
(Continued)

(58) Field of Classification Search
CPC ..... C12Q 2565/629; F15B 29/00; B01L 13/5027; B01L 17/52; B01L 2200/027; B01L 2200/147; B01L 2300/18
See application file for complete search history.

(56) References Cited

U.S. PATENT DOCUMENTS

2002/0072122 A1 6/2002 Copeland et al.
2004/0000712 A1 1/2004 Wilson et al.
(Continued)

FOREIGN PATENT DOCUMENTS

JP 2011-071301 4/2011

OTHER PUBLICATIONS

Crews et al "Spatial DNA melting analysis for genotyping and variant scanning", Anal. Chem. 2009, 81: 2053-2058. (Year: 2009).*
(Continued)

*Primary Examiner* — Narayan K Bhat
(74) *Attorney, Agent, or Firm* — Canon U.S.A., Inc., IP Division

(57) ABSTRACT

The present invention relates to methods and systems that result in high quality, reproducible, thermal melt analysis on a microfluidic platform. The present invention relates to methods and systems using thermal systems including heat spreading devices, including interconnection methods and materials developed to connect heat spreaders to microfluidic devices. The present invention also relates to methods and systems for controlling, measuring, and calibrating the thermal systems of the present invention.

36 Claims, 35 Drawing Sheets

Related U.S. Application Data

(60) Provisional application No. 61/487,081, filed on May 17, 2011, provisional application No. 61/487,069, filed on May 17, 2011, provisional application No. 61/487,269, filed on May 17, 2011.

(51) Int. Cl.
*B01L 3/00* (2006.01)
*B01L 7/00* (2006.01)

(52) U.S. Cl.
CPC ..... *B01L 2300/1844* (2013.01); *B01L 2300/1894* (2013.01); *Y10T 436/143333* (2015.01)

(56) References Cited

U.S. PATENT DOCUMENTS

| | | | | |
|---|---|---|---|---|
| 2004/0151629 | A1 | 8/2004 | Pease et al. | |
| 2007/0231799 | A1 | 10/2007 | Knight et al. | |
| 2008/0124723 | A1* | 5/2008 | Dale ..... | G06T 7/11 435/6.16 |
| 2009/0143233 | A1 | 6/2009 | Knight et al. | |
| 2009/0145576 | A1 | 6/2009 | Wyrick et al. | |
| 2009/0317874 | A1 | 12/2009 | Dale et al. | |
| 2010/0165784 | A1 | 7/2010 | Jovanovich et al. | |
| 2010/0173394 | A1* | 7/2010 | Colston, Jr. ..... | B01F 3/0807 435/287.2 |
| 2011/0056926 | A1 | 3/2011 | Coursey | |
| 2011/0077897 | A1 | 3/2011 | Hasson et al. | |

OTHER PUBLICATIONS

Guschin et al "Oligonucleotide microships as genosensors for determinative and environmental studies in microbiology" Applied and Environmental microbiology, 1997, 63:(6): 2397-2402. (Year: 1997).*

PCT International Search Report issued in PCT/US2012/038427, dated May 13, 2013.

Supplementary European Search Report issued in EP12863934, dated Sep. 9, 2015.

Supplementary Partial European Search Report issued in EP12863934, dated Apr. 30, 2015.

* cited by examiner

*3

*3

SYSTEMS AND METHODS USING EXTERNAL HEATER SYSTEMS IN MICROFLUIDIC DEVICES

CROSS REFERENCE TO RELATED APPLICATIONS

This application is a Divisional of U.S. patent application Ser. No. 13/474,523 filed May 17, 2012, issued Jan. 24, 2017 as U.S. Pat. No. 9,554,422 which application claims the benefit of U.S. Provisional Patent Application Ser. Nos. 61/487,269, 61/487,081, and 61/487,069, all of which were filed May 17, 2011, the contents of which are incorporated herein by reference in their entirety.

Reference is also made to the following U.S. Patents and applications, each of which are incorporated herein in their entirety: U.S. Pat. No. 7,943,320 issued May 17, 2011 entitled "Unsymmetrical Cyanine Dyes for High Resolution Nucleic Acid Melting Analysis, U.S. patent application Ser. No. 11/352,452, entitled "Method and apparatus for generating thermal melting curves in a microfluidic device" published Feb. 1, 2007 as US 2007/0026421, U.S. patent application Ser. No. 11/381,896 entitled "Method and Apparatus for Applying Continuous Flow and Uniform Temperature to Generate Thermal Melting Curves in a Microfluidic Device" published Oct. 4, 2007 as US 2007/0231799, U.S. patent application Ser. No. 12/825,476 entitled "Microfluidic Devices, Methods and Systems for Thermal Control" published Mar. 3, 2011 as US 2011/0048547, U.S. patent application Ser. No. 13/223,258 filed Aug. 31, 2011 entitled "Thermal Calibration", U.S. patent application Ser. No. 13/223,270 filed Aug. 31, 2011 entitled "Compound Calibrator for Thermal Sensors" published Mar. 1, 2012 as US2012/0051390, and U.S. patent application Ser. No. 13/223,290 filed Aug. 31, 2011 entitled "System and Method for Rapid Serial Processing of Multiple Nucleic Acid Assays" published Mar. 1, 2012 as US2012/0052560.

FIELD OF THE INVENTION

The present invention relates to heating systems for microfluidic devices and temperature control of the microfluidic devices for performing biological reactions. More specifically, the present invention relates to systems and methods for calibrating, and determining and controlling the temperature of external heater systems utilizing heat spreaders in microfluidic devices.

BACKGROUND

The detection of nucleic acids is central to medicine, forensic science, industrial processing, crop and animal breeding, and many other fields. The ability to detect disease conditions (e.g., cancer), infectious organisms (e.g., HIV), genetic lineage, genetic markers, and the like, is ubiquitous technology for disease diagnosis and prognosis, marker assisted selection, identification of crime scene features, the ability to propagate industrial organisms and many other techniques. Determination of the integrity of a nucleic acid of interest can be relevant to the pathology of an infection or cancer.

One of the most powerful and basic technologies to detect small quantities of nucleic acids is to replicate some or all of a nucleic acid sequence many times, and then analyze the amplification products. Polymerase chain reaction (PCR) is a well-known technique for amplifying deoxyribonucleic acid (DNA). With PCR, one can produce millions of copies of DNA starting from a single template DNA molecule. PCR includes phases of "denaturation," "annealing," and "extension." These phases are part of a cycle which is repeated a number of times so that at the end of the process there are enough copies to be detected and analyzed. For general details concerning PCR, see Sambrook and Russell, Molecular Cloning—A Laboratory Manual (3rd Ed.), Vols. 1-3, Cold Spring Harbor Laboratory, Cold Spring Harbor, N.Y. (2000); Current Protocols in Molecular Biology, F. M. Ausubel et al., eds., Current Protocols, a joint venture between Greene Publishing Associates, Inc. and John Wiley & Sons, Inc., (supplemented through 2005) and PCR Protocols A Guide to Methods and Applications, M. A. Innis et al., eds., Academic Press Inc. San Diego, Calif. (1990).

The PCR process phases of denaturing, annealing, and extension occur at different temperatures and cause target DNA molecule samples to replicate themselves. Temperature cycling (thermocyling) requirements vary with particular nucleic acid samples and assays. In the denaturing phase, a double stranded DNA (dsDNA) is thermally separated into single stranded DNA (ssDNA). During the annealing phase, primers are attached to the single stranded DNA molecules. Single stranded DNA molecules grow to double stranded DNA again in the extension phase through specific bindings between nucleotides in the PCR solution and the single stranded DNA. Typical temperatures are 95° C. for denaturing, 55° C. for annealing, and 72° C. for extension. The temperature is held at each phase for a certain amount of time which may be a fraction of a second up to a few tens of seconds. The DNA is doubled at each cycle, and it generally takes 20 to 40 cycles to produce enough DNA for certain applications. To have good yield of target product, one has to accurately control the sample temperatures at the different phases to a specified degree.

More recently, a number of high throughput approaches to performing PCR and other amplification reactions have been developed, e.g., involving amplification reactions in microfluidic devices, as well as methods for detecting and analyzing amplified nucleic acids in or on the devices. Thermal cycling of the sample for amplification is usually accomplished in one of two methods. In the first method, the sample solution is loaded into the device and the temperature is cycled in time, much like a conventional PCR instrument. In the second method, the sample solution is pumped continuously through spatially varying temperature zones. See, for example, Lagally et al. (Analytical Chemistry 73:565-570 (2001)), Kopp et al. (Science 280:1046-1048 (1998)), Park et al. (Analytical Chemistry 75:6029-6033 (2003)), Hahn et al. (WO 2005/075683), Enzelberger et al. (U.S. Pat. No. 6,960,437) and Knapp et al. (U.S. Patent Application Publication No. 2005/0042639).

Many detection methods require a determined large number of copies (millions, for example) of the original DNA molecule, in order for the DNA to be characterized. Because the total number of cycles is fixed with respect to the number of desired copies, the only way to reduce the process time is to reduce the length of a cycle. Thus, the total process time may be significantly reduced by rapidly heating and cooling samples to process phase temperatures while accurately maintaining those temperatures for the process phase duration.

The technique of melt analysis is becoming a standard tool for analyzing nucleic acid molecules following amplification. Melt analysis is also referred to in the art as high resolution melting (HRM), thermal melting, and melt curve analysis, and relies on the principles of the denaturing phase of amplification. That is, as a double stranded DNA (dsDNA) is subjected to increased temperatures, at a particularly temperature the dsDNA will be separated into single stranded DNA (ssDNA), thereby releasing any bound detection agents such as fluorescence markers, which can be optically detected and analyzed. These techniques are widely used, however, most systems rely on a heater block into which samples are inserted, spinning the sample tube/capillary through heated air, or establishing a temperature gradient that subjects the sample to different temperatures based on its position along the gradient. The temperature measurements are therefore based on measurement of the heater block, the air, or the opposite ends of the temperature gradient.

For instance, U.S. Pat. No. 7,785,776 from Idaho Technology, Inc., and the University of Utah Research Foundation describes at column 19 how "the high-resolution instrument also ensures greater temperature homogeneity within the sample because the cylindrical capillary is completely surrounded by an aluminum cylinder."

Similarly, U.S. Pat. No. 7,582,429 from the University of Utah Research Foundation provides an overview in paragraph 3 of a number of commercial instruments with melt capabilities: "Various types of thermocyclers have been described in the literature to perform PCR. Some types of thermocyclers with HRM that may be employed with the present embodiments include and are not limited to the AB7300, the HR-1TM, the LightCycler 480®, the Master Cycler®, the LightScanner® and the RotorGene™. Each of these instruments typically provides a real time PCR reaction followed by HRM." However, each of these devices use a heater block in which tubes or capillaries are inserted or feature capillaries that are spun in air as in the Rotor-Gene Q.

Further, U.S. patent application Ser. No. 12/514,671 from the University of Utah Research Foundation describes the typical alternate configuration of melting analysis based on a spatial temperature gradient (i.e., temperature is made intentionally non-uniform).

A high throughput device is desired that creates melt curves that are sufficiently reproducible such that small changes in melt temperature or curve shape can be accurately distinguished. Specifically, the heating system to create these melt curves must have high reproducibility so that small changes in the melt curves can be attributed to deviations in the patient samples (i.e., mutations) rather than merely unwanted deviations in the heating system.

The art describes methods for parallel processing of patient samples using large fixed heater blocks. Throughput is limited by the size of the heater block which holds a fixed number of patient samples and is slow to heat. Reproducibility also suffers when heating blocks are large due to non-uniformity of temperature. Other approaches including those based on capillaries have similar shortcomings in the balance between throughput and reproducibility.

Accordingly, there is a need in the art for a high throughput system that subjects each sample to a controlled and uniform temperature profile.

SUMMARY OF THE INVENTION

The present invention relates to methods and systems for microfluidic devices, including microfluidic devices useful in the analysis of the dissociation behavior of nucleic acids and the identification of nucleic acids. More specifically, embodiments of the present invention relate to methods and systems for heating a microfluidic device, including for the analysis of denaturation data of nucleic acids. Further, embodiments of the present invention relate to methods and systems for calibration of heating systems for microfluidic devices.

In one embodiment, the present invention provides a heating system for microfluidic devices comprising a microfluidic device having one or more reservoirs or channels, a heat spreader, wherein the heat spreader is affixed to the microfluidic device such that the reservoirs or channels disposed on said microfluidic device are in thermal communication with the heat spreader; a heating means for heating the heat spreader; and, a measuring means for measuring one or more temperatures of the channels or reservoirs, wherein the measuring means comprises one or more temperature sensors. According to this embodiment, the measuring means comprises one or more temperature sensors selected from the group comprising temperature sensors embedded within the microfluidic device and temperature sensors external to the microfluidic device. In one embodiment, the one or more external sensors have a thermal capacitance that is matched to that of the temperature zone on the microfluidic device. In a further embodiment, the embedded sensors are passivated to prevent direct contact with samples in the one or more reservoirs or fluidic channels. In another embodiment, the passivation materials comprise one or more of the following: glass, silicon dioxide, silicon nitride, silicon, polysilicon, parylene, polyimide, Kapton, or benzocyclobutene (BCB).

In one embodiment, the system further comprises an external resistive heater. In a further embodiment, the system further comprises (i) an external resistive heater and an external temperature sensor attached to the heat spreader and (ii) at least one embedded resistance temperature detector (RTD). In yet a further embodiment, the at least one embedded RTD acts as both a temperature sensor and a heater. In one embodiment, the at least one RTD and the heat spreader are located spatially apart on the microfluidic device. In another embodiment, the at least one RTD is located at least partially beneath the heat spreader.

In one embodiment, the heat spreader is symmetric in at least one direction. In another embodiment, the heat spreader is made from an anisotropic thermally conductive material or from a composite including an anisotropic thermally conductive material. In a further embodiment, an anisotropic thermally conductive thermal interface material connects the heat spreader to the microfluidic device. In yet another embodiment, the anisotropic thermally conductive materials are chosen from the group consisting of: graphite, graphene, diamonds of natural or synthetic origin, or carbon nanotubes (CNTs). In another embodiment, the anisotropic thermally conductive material is configured such that its orientation exhibiting the highest thermal conductance is aligned with the orientation in which of the one or more reservoirs or channels are disposed on the microfluidic device.

In another embodiment, the system further comprises a heat spreader that includes one or more recesses for attachment of one or more sensors. In a further embodiment, insulation is present over at least one temperature sensor located on the heat spreader. In one embodiment, the heat spreader is affixed to the microfluidic device by applying high pressure. In a further embodiment, the high pressure is generated by pneumatics, spring assemblies, drive screws, or dead weight. In yet another embodiment, the heat spreader is permanently affixed to the microfluidic device. In one embodiment, the permanent bond is made with cyanoacrylate adhesive.

In one embodiment, the heat spreader is affixed to the microfluidic device using a material that includes nano or microparticles to increase the thermal conductance of the interconnection. In another embodiment, the nano or microparticles are selected from the group comprising: silver, gold, aluminum and alloys thereof, copper and alloys thereof, zinc, tin, iron, CNTs, graphite, natural diamond, synthetic diamond, alumina, silica, titania, zinc oxide, tin oxide, iron oxide, and beryllium oxide.

In another embodiment, the system further comprises a cooling means to adjust the temperature of the heat spreader or the one or more fluidic channels or reservoirs. In one embodiment, the cooling means is configured to limit heat losses from samples present in the one or more fluidic channels or reservoirs. In another embodiment, the cooling means improves uniformity of temperature in the temperature zone by limiting heat losses. In a further embodiment, the cooling means is a PWM fan or blower.

In one embodiment, the present invention provides a system that is configured for performing nucleic acid melt analysis occurs on the microfluidic device. In another embodiment, amplification of DNA occurs on the microfluidic device prior to nucleic acid melt analysis. In a further embodiment, the nucleic acid melt analysis determines the genotype of biological samples provided on the microfluidic device.

In one aspect of the invention, there is provided a method of uniformly heating a microfluidic device comprising providing a microfluidic device having one or more fluidic channels or reservoirs wherein the microfluidic device has a thermally conductive heat spreader in thermal contact with the microfluidic device, using a heating means to increase the temperature of the heat spreader to create a substantially uniform temperature zone on the microfluidic device, and using a measuring means to determine the temperature of the heat spreader or the one or more fluidic channels or reservoirs.

In one embodiment, the measuring means comprises one or more temperature sensors selected from the group comprising temperature sensors embedded within the microfluidic device and temperature sensors external to the microfluidic device. In another embodiment, the heat spreader includes one or more recesses for attachment of one or more temperature sensors. In a further embodiment, insulation is present over at least one temperature sensor located on the heat spreader. In one embodiment, the external temperature sensor is in contact with the microfluidic device or the heat spreader. In another embodiment, the temperature sensor additionally controls the heating means.

In one embodiment, the microfluidic device further comprises an external resistive heater. In a further embodiment, the microfluidic device further comprises (i) an external resistive heater and an external temperature sensor attached to the heat spreader and (ii) at least one embedded resistance temperature detector (RTD). In yet a further embodiment, the at least one embedded RTD acts as both a temperature sensor and a heater. In one embodiment, the at least one RTD and the heat spreader are located spatially apart on the microfluidic device. In another embodiment, the at least one RTD is located at least partially beneath the heat spreader.

In one embodiment, the method further comprises the step of using a cooling means to adjust the temperature of the heat spreader or the one or more fluidic channels or reservoirs in response to the temperature measurements obtained. In one embodiment, the cooling means is configured to limit heat losses from samples present in the one or more fluidic channels or reservoirs. In another embodiment, the cooling means improves uniformity of temperature in the temperature zone by limiting heat losses. In a further embodiment, the cooling means is a PWM fan or blower.

In another embodiment, the temperature sensor comprises at least one interchangeable external sensor attached to the heat spreader. In a further embodiment the heat spreader is symmetric in at least one direction. In one embodiment, the heat spreader is made from an anisotropic thermally conductive material or from a composite including an anisotropic thermally conductive material. In another embodiment, an anisotropic thermally conductive thermal interface material connects the heat spreader to the microfluidic device. In a further embodiment, the anisotropic thermally conductive materials are chosen from the group consisting of: graphite, graphene, diamonds of natural or synthetic origin, or carbon nanotubes (CNTs). In a yet further embodiment, the anisotropic thermally conductive material is configured such that its orientation exhibiting the highest thermal conductance is aligned with the orientation in which of the one or more reservoirs or channels are disposed on the microfluidic device.

In one embodiment, the heat spreader is affixed to the microfluidic device by applying high pressure. In another embodiment, the heat spreader is permanently affixed to the microfluidic device. In a further embodiment, the permanent bond is made with cyanoacrylate adhesive. In another embodiment, the heat spreader is affixed to the microfluidic device using a material that includes nano or microparticles to increase the thermal conductance of the interconnection. In yet another embedment, the nano or microparticles are selected from the group comprising: silver, gold, aluminum and alloys thereof, copper and alloys thereof, zinc, tin, iron, CNTs, graphite, natural diamond, synthetic diamond, alumina, silica, titania, zinc oxide, tin oxide, iron oxide, and beryllium oxide.

In one embodiment, the method additionally comprising calibrating the heating means, wherein calibrating the heating means comprises analyzing temperature data from at least one sensor in contact with the heat spreader to determine whether a smooth heating profile exists, and adjusting the heating means if necessary to obtain a smooth heating profile. In another embodiment, calibrating the heating means comprises analyzing data from one or more sensor elements embedded on the microfluidic device to monitor the dynamic response of a temperature sensor that is external to the microfluidic device while being in thermal communication with the microfluidic device. In one embodiment, calibrating the heating means further includes introducing a control sample having known thermal characteristics into one or more fluidic channels or reservoirs. In another embodiment, the known thermal characteristic is a melting temperature for a nucleic acid and wherein the control sample comprises one or more of wild type DNA, amplicon, oligonucleotide, or a mixture thereof. In a further embodiment, the control sample comprises an ultra-conserved element (UCE). In a yet further embodiment, the control sample is introduced into one or more fluidic channels or reservoirs that are in the same uniform temperature zone as one or more fluidic channels or reservoirs that contain an unknown sample.

In another embodiment, the one or more external sensors have a thermal capacitance that is matched to that of the temperature zone on the microfluidic device. In another embodiment, the heating comprises increasing the temperature of the heat spreader from a first temperature to a second temperature, such that any nucleic acid containing samples in the one or more fluidic channels or reservoirs are subjected to nucleic acid melt analysis.

In one embodiment, any nucleic acids present in a sample is subjected to nucleic acid amplification on the microfluidic device prior to melt analysis. In another embodiment, the nucleic acid melt analysis determines the genotype of the samples.

In another embodiment, the one or more embedded temperature sensors is located underneath the reservoirs or fluidic channels on the microfluidic device. In one embodiment, the embedded sensors are passivated to prevent direct contact with samples in the one or more reservoirs or fluidic channels. In a further embodiment, the passivation materials comprise one or more of the following: glass, silicon dioxide, silicon nitride, silicon, polysilicon, parylene, polyimide, Kapton, or benzocyclobutene (BCB).

In one aspect, the present invention provides a method of calibrating heating means on a microfluidic device, comprising providing a microfluidic device, the microfluidic device comprising one or more microfluidic channels, heating means in thermal communication with the microfluidic device, wherein the heating means comprises a heat spreader affixed to the microfluidic device and one or more temperature sensors in thermal communication with the heat spreader, means for moving fluid through the microfluidic channels, temperature measuring means, an optical detection system; and analysis means, introducing a control sample with known thermal properties into one or more microfluidic channels, causing the control sample to move into the microfluidic channel, causing the heating means to gradually increase the temperature of the microfluidic channel, monitoring the control sample for optical signals with the optical detection system and or monitoring temperature data from at least one sensor in contact with the heat spreader, analyzing the temperature data to determine whether a smooth heating profile exists, and adjusting the heating means if necessary to obtain a smooth heating profile. In one embodiment, the control sample comprises one or more of: wild type DNA, amplicon, oligonucleotide, or a mixture thereof. In another embodiment, the control sample comprises an ultra-conserved element (UCE). In a further embodiment, the known thermal property is the melting temperature of the nucleic acid.

In one embodiment, the microfluidic device further comprises an external resistive heater. In a further embodiment, the microfluidic device further comprises (i) an external resistive heater and an external temperature sensor attached to the heat spreader and (ii) at least one embedded resistance temperature detector (RTD). In yet a further embodiment, the at least one embedded RTD acts as both a temperature sensor and a heater. In one embodiment, the at least one RTD and the heat spreader are located spatially apart on the microfluidic device. In another embodiment, the at least one RTD is located at least partially beneath the heat spreader.

In another aspect, the present invention provides a method of performing nucleic acid melt analysis on a microfluidic device, comprising providing a microfluidic device, wherein the microfluidic device comprises one or more microfluidic channels, heating means in thermal communication with the microfluidic device, wherein the heating means comprises a heat spreader affixed to the microfluidic device, an external heater, and one or more temperature sensors in thermal communication with the heat spreader, means for moving fluid through the microfluidic channels, temperature measuring means, an optical detection system, and analysis means, introducing a biological sample into the microfluidic channel, causing the sample to move into the microfluidic channel, causing the heating means to gradually increase the temperature of the microfluidic channel, monitoring the sample for optical signals with the optical detection system, and analyzing the detected optical signals to determine the melting temperature of the sample. In one embodiment, the sample undergoes nucleic acid amplification in the microfluidic device prior to the nucleic acid melt analysis. In another embodiment, analyzing the detected optical signals comprises preparing melting temperature plots. In a further embodiment, the optical signal is a fluorescence signal. In one embodiment, the microfluidic device further comprises at least one embedded resistance temperature detector (RTD). In another embodiment, the at least one embedded RTD acts as both a temperature sensor and a heater. In a further embodiment, the at least one RTD and the heat spreader are located spatially apart on the microfluidic device. In another embodiment, the at least one RTD is at least partially beneath the heat spreader.

In one aspect, the present invention provides a microfluidic system comprising a microfluidic device comprising one or more microfluidic channels, heating means in thermal communication with the microfluidic device, wherein the heating means comprises a heat spreader affixed to the microfluidic device and one or more temperature sensors in thermal communication with the heat spreader, means for moving fluid through the microfluidic channels, temperature measuring means, an optical detection system, and analysis means.

DETAILED DESCRIPTION

Embodiments of the heating systems for microfluidic devices and systems and methods for temperature control of the microfluidic devices for performing biological reactions are described herein with reference to the figures.

Figure 1:
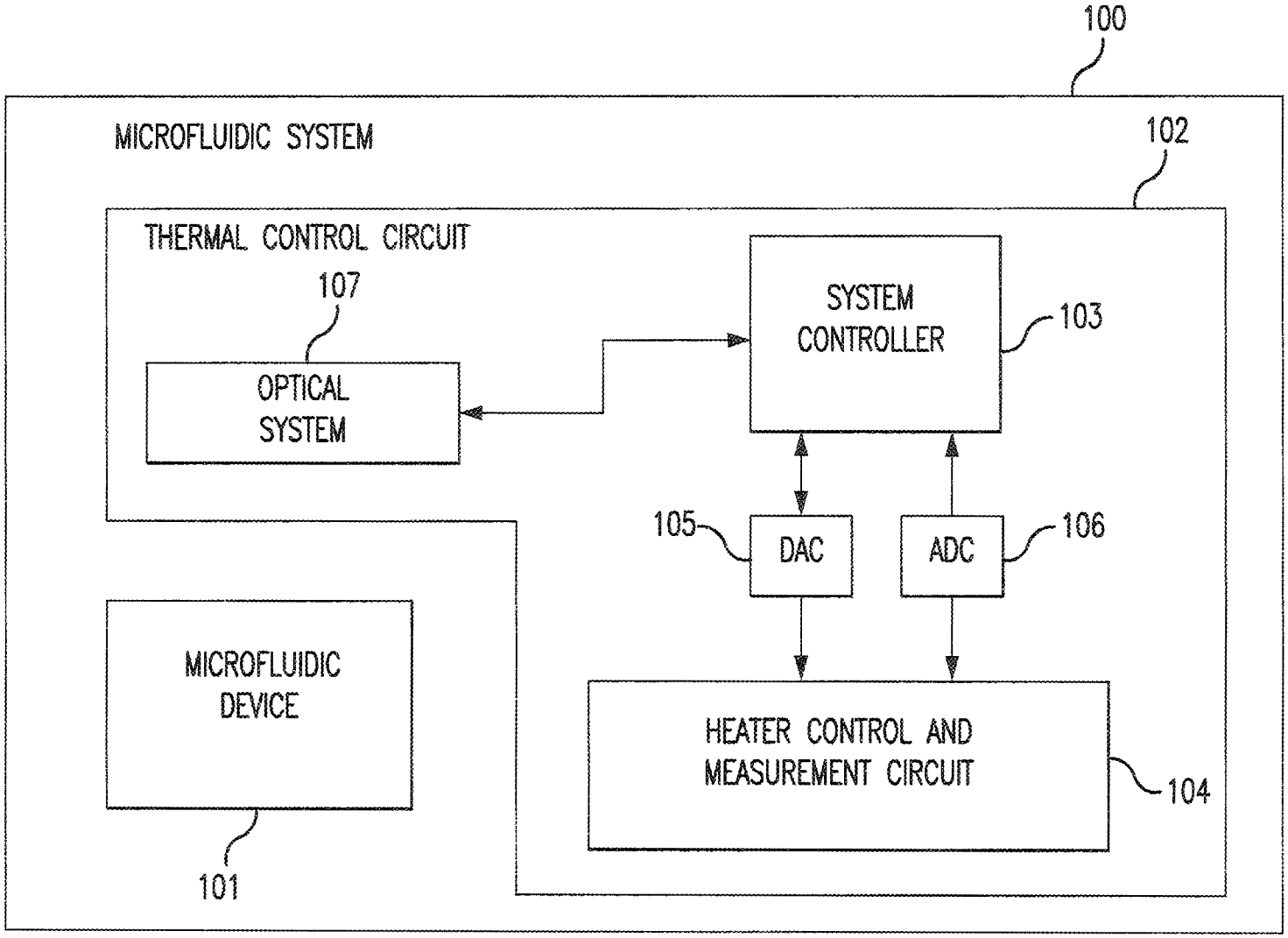
FIG. 1 is a system diagram.

FIG. 1 illustrates a microfluidic system 100 according to one embodiment of the present invention. As shown in FIG. 1, microfluidic system 100 has a microfluidic device 101 and a thermal control circuit 102. Thermal control circuit 102 has a system controller 103, heater control and measurement circuit 104, digital to analog converter (DAC) 105 and analog to digital converter (ADC) 106. Although DAC 105 and ADC 106 are shown in FIG. 1 as separate from system controller 103 and heater control and measurement circuit 104, DAC 105 and ADC 106 may alternatively be part of system controller 103 or heater control and measurement circuit 104. In addition, thermal control circuit 102 may include an optical system 107 to monitor microfluidic device 101.

Compact microfluidic devices require numerous functions within a limited space. In one embodiment, the present invention is a highly efficient microfluidic device 101 for use in molecular diagnostics. Two possible specific applications are polymerase chain reaction (PCR) and high resolution thermal melt.

PCR is one of the most common and critical processes in molecular diagnostics and other genomics applications that require DNA amplification. In PCR, target DNA molecules are replicated through a three phase temperature cycle of denaturation, annealing, and extension. In the denaturation step, double stranded DNA is thermally separated into single stranded DNA. In the annealing step, primers hybridize to single stranded DNA. In the extension step, the primers are extended on the target DNA molecule with the incorporation of nucleotides by a polymerase enzyme.

Typical PCR temperatures are 95° C. for denaturation, 55° C. for annealing, and 72° C. for extension. The temperature during a step may be held for an amount of time from fractions of a second to several seconds. In principle, the DNA doubles in amount at each cycle, and it takes approximately 20 to 40 cycles to complete a desired amount of amplification. To have good yield of target product, one has to control the sample temperatures at each step to the desired temperature for each step. To reduce the process time, one has to heat and cool the samples to desired temperature very quickly, and keep those temperatures for the desired length of time to complete the synthesis of the DNA molecules in each cycle.

Figure 2:
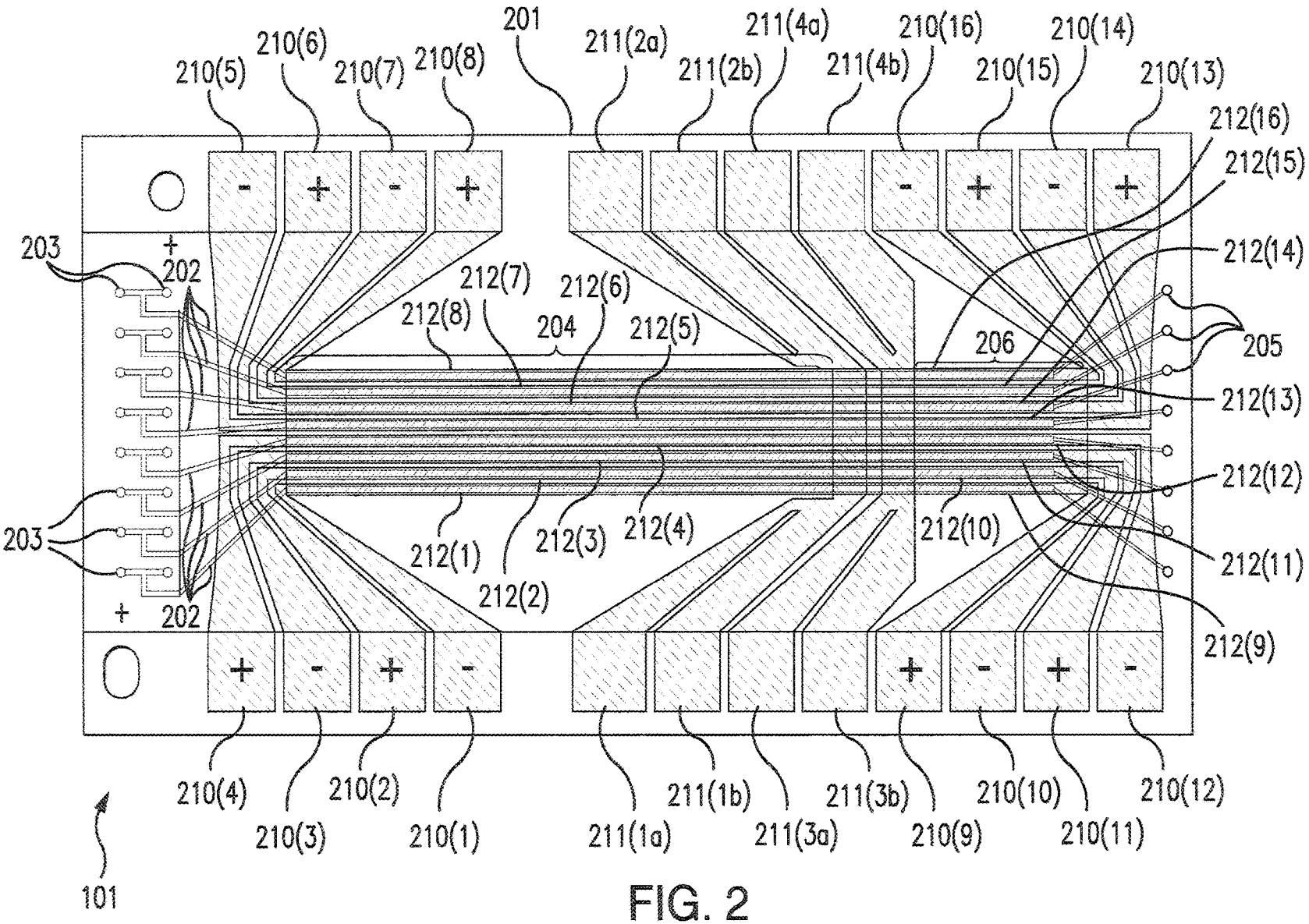
FIG. 2 is a diagram of a microfluidic chip.

The microfluidic device 101 shown in FIG. 2 can be utilized in accordance with the external heaters of the present invention. FIG. 22 illustrated a plurality of microchannels 202 that are adjacent to thin-film resistive temperature detectors (RTDs) 212. For example, microchannels 202 may be underlain with RTDs 212. The RTDs 212 function as precise temperature sensors as well as quick response heaters. Further, to decrease waste heat and better thermally isolate separate functional zones 204 (i.e., zone 1 or the PCR zone) and 206 (i.e., zone 2 or the PCR zone), the thin-film RTDs include lead wires or electrodes 210 and 211 which are more conductive than the RTDs 212. The electrodes 210 and 211 may be any suitable conductive material and, in one preferred embodiment, are gold. The RTDs 212 may be made from any suitable resistive material that demonstrates good response to temperature and is capable of being used as a heater. Suitable RTD materials include, but are not limited to, platinum and nickel.

As shown in FIG. 2, microfluidic device 101 may have a plurality of microfluidic channels 202 extending across a substrate 201. The illustrated embodiment shows eight channels 202; however, fewer or more channels could be included. Each channel 202 may include one or more inlet ports 203 (the illustrated embodiment shows two inlet ports 203 per channel 202) and one or more outlet ports 205 (the illustrated embodiment shows one outlet port 205 per channel 202). Each channel may include a first portion extending through a PCR thermal zone 204 and a second portion extending through a thermal melt zone 206. A sipper (not illustrated) can be used to draw liquid into the plurality of microfluidic channels 202.

The microfluidic device 200 further includes heater elements, which may be in the form of thin film resistive thermal detectors (RTDs) 212. In one embodiment, one or more heater element 212 are associated with each microfluidic channel 202 and are located adjacent to the microfluidic channel 202. For example, each microfluidic channel 202 may be situated above (or otherwise adjacent to) on one or more heating element 212. In the illustrated embodiment, heater element 212(1)-(8) are associated with the microfluidic channels 202 in PCR thermal zone 204 and heater elements 212(9)-(16) are associated with the microfluidic channels located in thermal melt zone 206. For example, heater elements 212(1) and 212(9) are associated with one microfluidic channel 202 with heater element 212(1) being located in PCR thermal zone 204 and heater element 212(9) being located in thermal melt zone 206.

Heater electrodes 210 and 211 can provide electrical power to the plurality of heating elements 212. To best utilize the limited space provided by substrate 201 of microfluidic device 101 and reduce the number of electrical connections required, multiple RTDs share a pair of common electrodes 211. Heater electrodes 210 and 211 include individual electrodes 210 and common electrodes 211. Each pair of common electrodes includes, for example, a first common electrode 211(*a*) and a second common electrode 211(*b*). The pairs of common electrodes 211 allow the microfluidic sensors to be controlled in three-wire mode.

As an example in FIG. 2, there are sixteen RTD heater elements 212(1)-212(16), sixteen individual electrodes 210(1)-210(16) and four common electrode pairs 211(1)-211(4). Accordingly, as illustrated in FIG. 2, there are four first common electrodes 211(1*a*)-211(4*a*) and four second common electrodes 211(1*b*)-211(4*b*). Each heater element 212 is connected to an individual electrode 210 and a pair of common electrodes 211. Multiple heater elements 212 share a pair of common electrodes 211 and are thereby multiplexed with the pair of common electrodes 211. For example, RTD 212(1) is connected to individual electrode 210(1) and a pair of common electrodes 211(1*a*) and 211(1*b*).

Although the microfluidic device 101 and resistor network shown in FIG. 2 has four heater elements 212 connected to each of the four pairs of common electrodes 211, more or fewer RTDs may be multiplexed with each pair of common electrodes 211. Furthermore, more or fewer pairs of common electrodes 211 may be used to create more or fewer multiplexed sets of heater elements.

Each of the heater elements 212 of microfluidic device 101 can be independently controlled for rapid heating and temperature sensing. As a result, the temperature of a microfluidic channel 202 in PCR thermal zone 204 may be controlled independently of the temperature of the microfluidic channel 202 in thermal melt zone 206. Also, the temperature of each microfluidic channel 202 in a zone 204 or 206 may be controlled independently of the temperature of the other microfluidic channels 202 in the zone 204 or 206.

Figure 3:
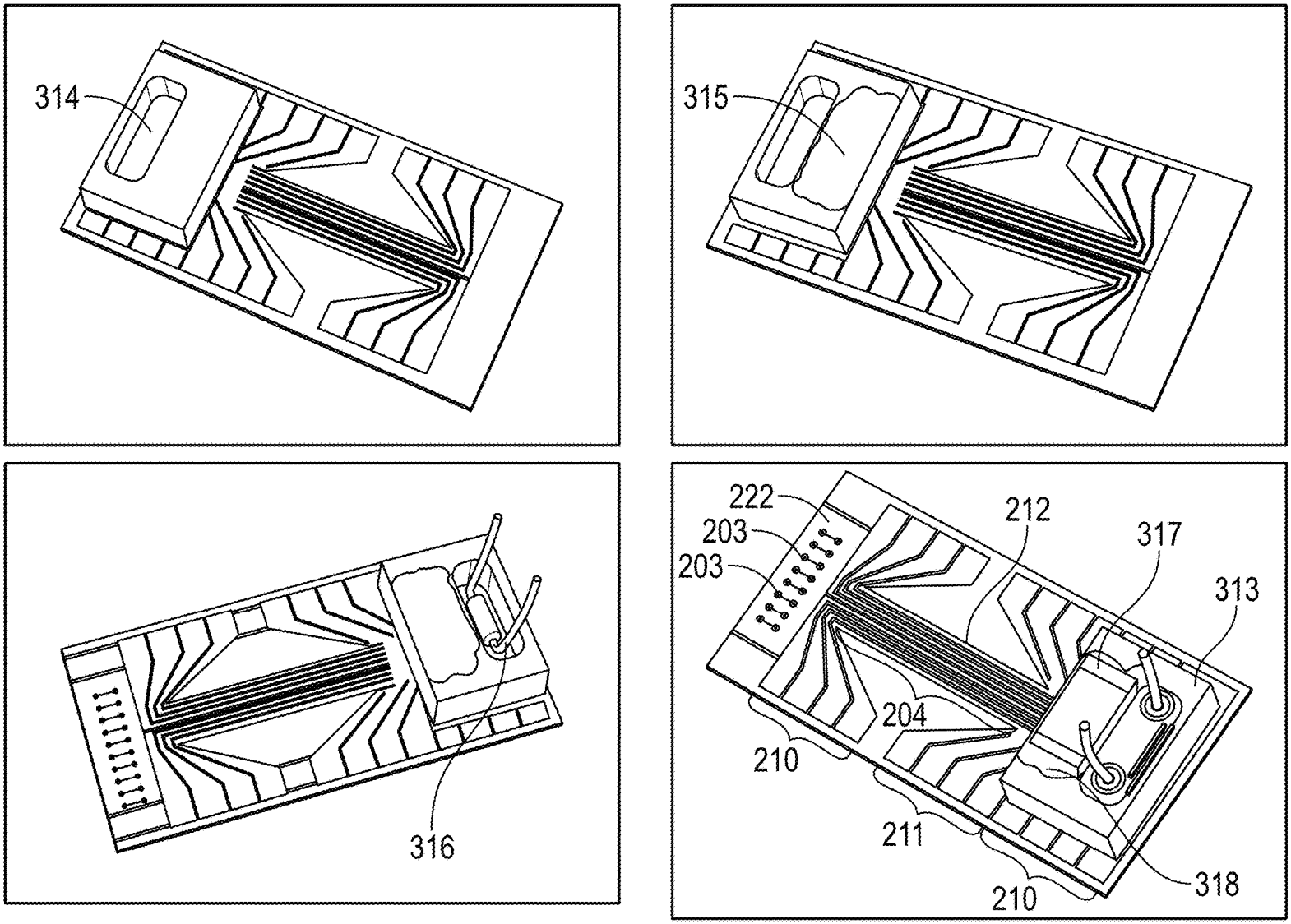
FIG. 3 shows a microfluidic chip having a heat spreader.

However, the microfluidic device 101, as depicted in FIG. 2, is subject to limitations on the uniformity of heating the microfluidic channels 202. Thus, in one embodiment of the present invention, as depicted in FIG. 3, a thermal heat spreader 313 is affixed to the microfluidic device 101. In one non-limiting embodiment, the heat spreader 313 may be affixed over zone 206 (i.e., zone 2 or the thermal melt zone).

The heat spreaders 313 and interconnection materials described in the present invention solve the problem of non-uniform heating and enable highly reproducible melt curves to be created because uniformity is ensured through physical configuration. The prior art has not addressed uniformity on the microscale or the reproducibility problem that exists whenever samples are placed into intermittent thermal contact with a heating system. Therefore, the present invention details how to design and construct heat spreaders 313 that addresses these challenges and results in improved melt results (and thus improved genotyping on systems designed for that purpose).

In one embodiment, suitable heat spreader 313 materials include but are not limited to: copper and its alloys, aluminum and its alloys, silver, ceramics (alumina and beryllium oxide among others), and anisotropic conductive materials such graphite and synthetic diamond (such as chemical vapor deposited (CVD) diamond wafers). Further, heat spreader 313 may be made from composite materials including any of the previously mentioned materials. A composite heat spreader 313 may be based on a low thermal conductance material such as a polymer resin, provided a high thermal conductance material is included to enhance the heat spreading capability. Other suitable materials to include in composite heat spreaders 313 include graphene and carbon nanotubes (CNTs) (both single and multiwall CNTs) which have exceptional and anisotropic thermal conductance.

The anisotropic heat spreader 313 preferably configured such that the orientation resulting in the highest thermal conductance is aligned to promote uniformity of temperature between the sample reservoirs/microchannels 202 disposed on the microfluidic device 101. In one specific example, for a microfluidic device 101 embedded with a plurality of microchannels on a given plane, the high conductance orientation of the heat spreader 313 would be aligned parallel to the plane featuring the microchannels 202.

Figure 4:
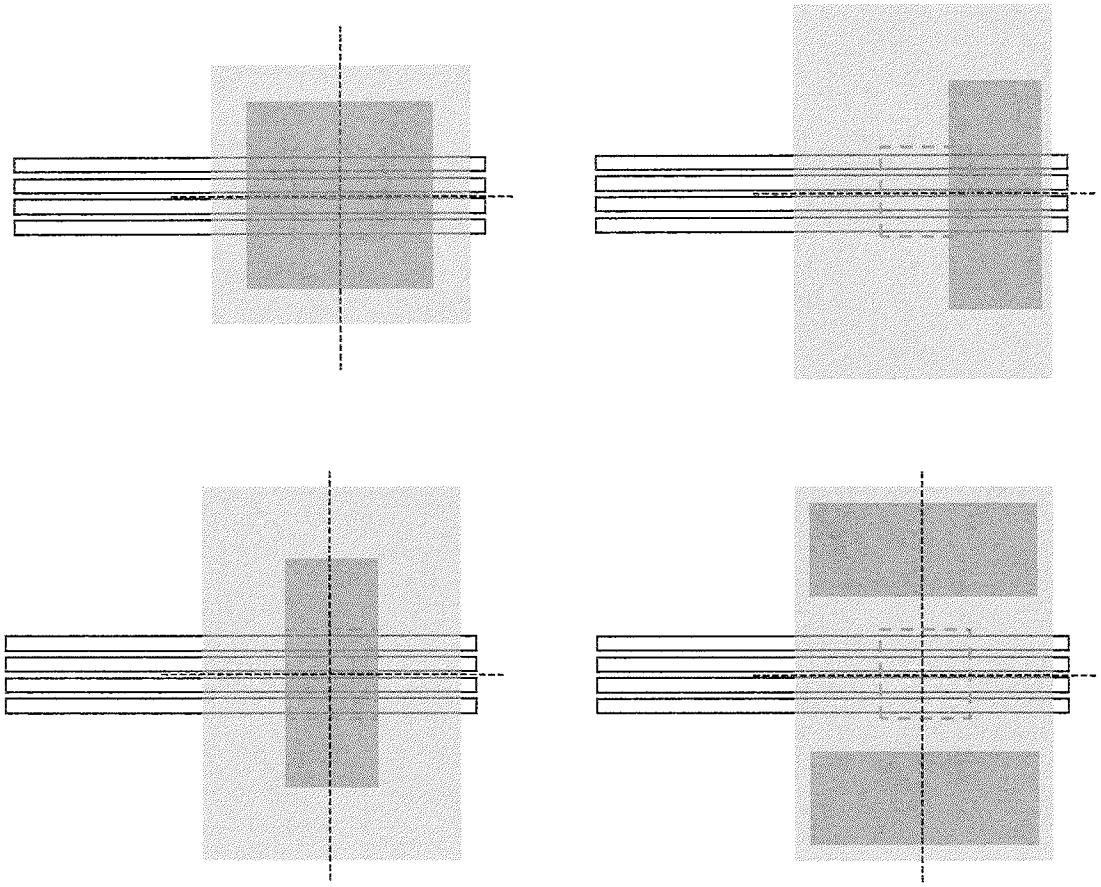
FIG. 4 depicts diagrams of symmetric heater system placements.
Figure 5A:
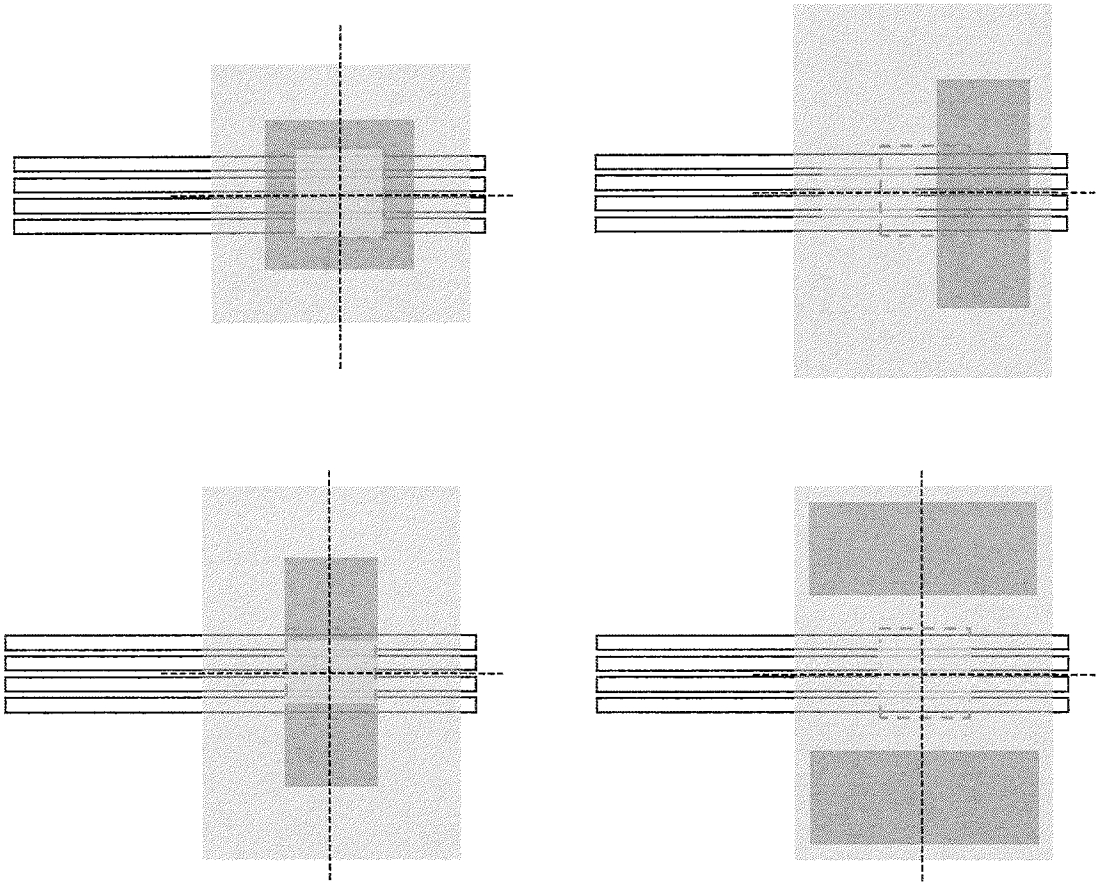
FIG. 5A-5B depicts diagrams of symmetric heater system placements.
Figure 5B:
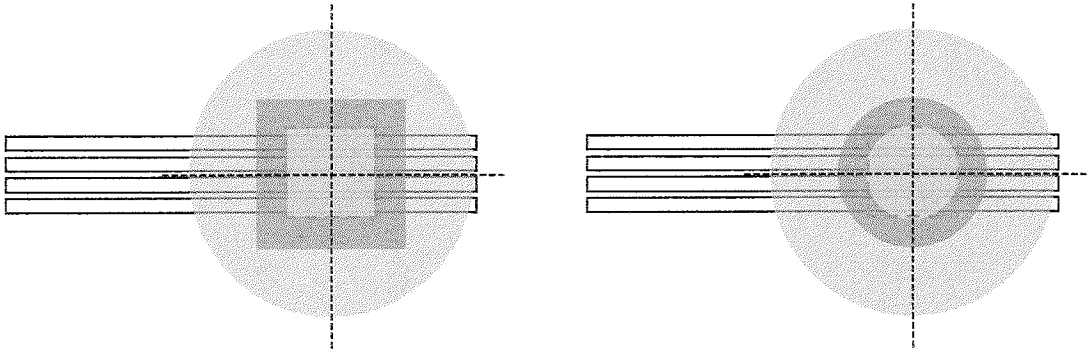

In some non-limiting embodiments of the present invention the heating system (including the heat spreader 313, heating means, and any external sensors) is symmetric with respect to the sample reservoirs/microchannels 202 and the melt analysis region 206. Making the system symmetric is preferable since it promotes thermal uniformity, ensuring that each sample experiences the same thermal profile. One or more lines of symmetry may be used to enhance the thermal uniformity. Preferably, the heat spreader 313 is symmetrically placed with respect to the melt analysis region 206. The heating element(s) and any temperature sensors are also preferably placed symmetrically with respect to the melt analysis region. Non-limiting examples of some symmetric heating system placements are shown in FIG. 4 and FIG. 5A-B, which have dashed lines indicating lines of symmetry.

The heat spreader 313 should be configured to ensure uniformity of temperature (to ensure melt reproducibility), through an efficient interconnection of the heat spreader 313 and the microfluidic device 101. To minimize the thermal resistance of the interconnection, the heat spreader 313 should be pressed against the microfluidic device 101 to eliminate or at least minimize air gaps. In one embodiment, thermal grease, silicones, graphite, mineral oil, metal foils (tin, lead, indium, silver, and alloys of these among others), nanoparticle loaded greases and silicones, and other gap filling materials may enhance the thermal conductance of an intermittent bond between the heat spreader 313 and the microfluidic device 101.

In one embodiment if an intermittent bond is to be made between the heat spreader 313 and the microfluidic device 101, it is preferable that it should be made under pressure. The pressure can be caused by the weight of the systems, but preferably used is high pressure up to 150 psi or more. The upper limit of the pressure is determined by the strength of the materials used to construct the device. In one embodiment, pressures in the range of 10-150 psi are preferred. In another embodiment, pneumatics, spring assemblies, drive screws, and dead weights may all be used to provide the required pressure.

In an alternate embodiment, thermal uniformity can be ensured by use of a permanent bond of the heat spreader 313 to the microfluidic device 101. A variety of methods were developed to permanently bond the heat spreader 313 to the microfluidic device 101. The heat spreader 313 is preferably bonded to the microfluidic device 101 using a thin, thermally conductive, material that results in a void free bond. Preferably, cyanoacrylate adhesives (often called instant, krazy, or super glues, for example, Loctite 420) are used for bonding since they have very low viscosity which allows them to be spread into a thin bond line. Alternative adhesives include any of the photo-activated (including ultraviolet), room temperature curing, or heat curing adhesives, or any other adhesives known to those of skill in the art having similar properties to allow a void free bond to form. In addition to being thermally conductive and uniform in thickness, it is preferable that the adhesive is stable at temperatures required for melt analysis (typically up to about 100° C. for melt analysis of DNA).

Alternatively, the microfluidic device 101 to heat spreader bond 313 could be made by an anisotropic thermal interface material (TIM) including, but not limited to, graphite, graphene, diamond (including those of natural and synthetic origin), or CNTs (including single and multiwall CNTs). These materials exhibit exceptional thermal conductance in at least one direction. The anisotropic material is preferably configured such that the orientation resulting in the highest thermal conductance is aligned to promote uniformity of temperature between the sample reservoirs/microchannels 202 disposed on the microfluidic device 101. In some embodiments, the TIM may include one or more additional adhesive layers such as pressure sensitive adhesive (PSA) that facilitate the adherence of the TIM. These additional adhesive layers may be silicone or acrylic based adhesives or others known to those skilled in the art.

Alternatively, an adhesive used to bond the microfluidic device to the heating system may include thermally conductive particles to enhance the overall thermal conductance of the bond. These particles may be nano or micro in scale and may include metal, carbon, and ceramic particles. Some suitable particles include but are not limited to silver, gold, aluminum and its alloys, copper and its alloys, zinc, tin, iron, CNTs, graphite, diamond, alumina, silica, titania, zinc oxide, tin oxide, iron oxide, and beryllium oxide. These same types of particles may be used in the nanoparticle loaded greases and silicones discussed above.

In order to ensure a thin bond line between the heating system and the microfluidic device, the bond is made under high pressure according to one embodiment of the present invention. In one embodiment, the high pressure can be made by pneumatics, spring assembly, drive screw, or dead weight. Alternatively, the pressure used may be as little as 1 psi or less. The upper limit of the pressure is determined by the strength of the materials used to construct the device. In one non-limiting embodiment, pressures in the range of 10-150 psi are preferred.

Figure 6:
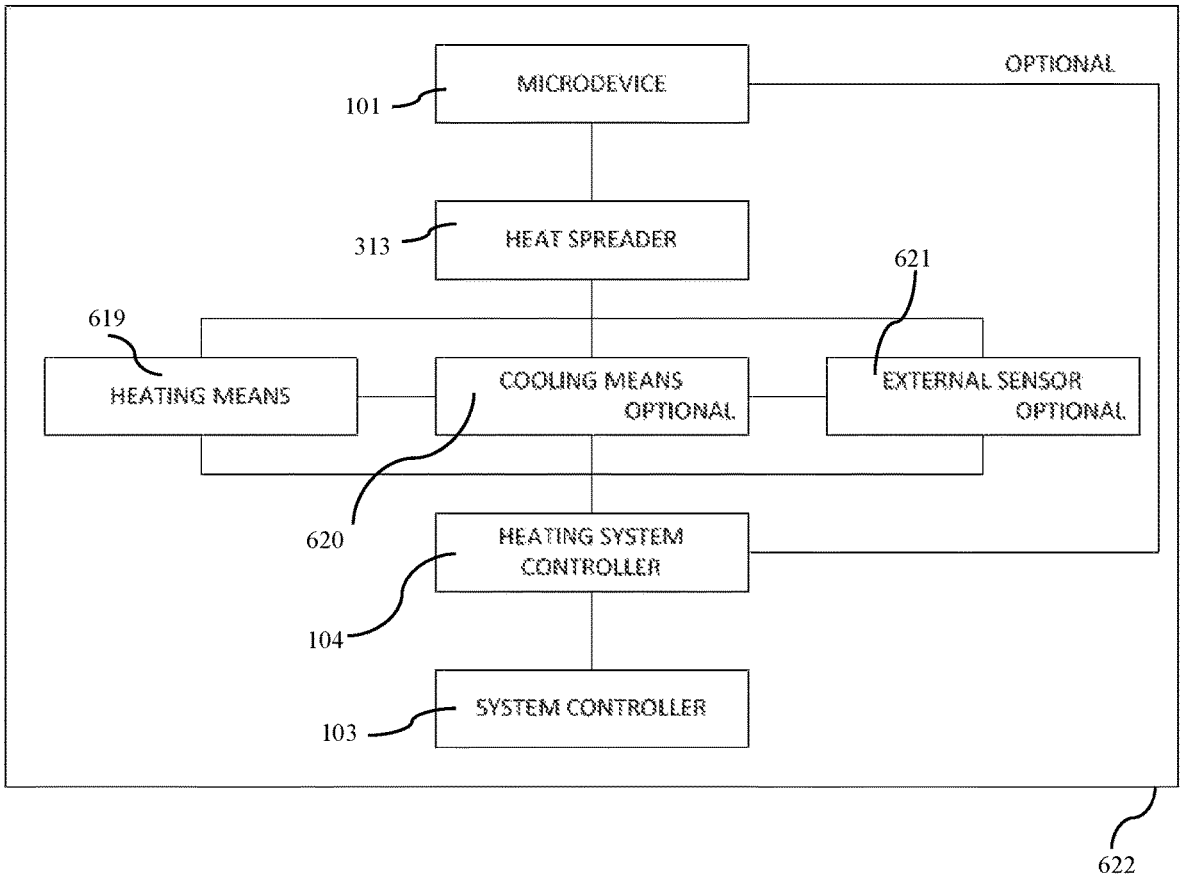
FIG. 6 is a system diagram.

In one embodiment of the present invention, the heat spreading devices 313 and interconnection materials described herein may be included in a microfluidic system 100, and may be more specifically included in a comprehensive heating system for melt analysis as shown in FIG. 6. In one embodiment, the comprehensive heating system may include a microfluidic device 101 that holds one or more samples to be processed for melt analysis. The samples may be in reservoirs or microchannels 202 and may be static or flowing through the device. The comprehensive heating system 622 may additionally include a heat spreader 313 that is configured to promote thermal uniformity in the melt analysis region of the microfluidic device 101. The heat spreader 313 is formed from a material (optionally a composite material) with good thermal conductance and must be in intimate contact with the microfluidic device 101. The contact between the heat spreader and the microfluidic device must be of low thermal resistance and is in some embodiments a permanent bond. The heating means 619 may include Joule and non-Joule heating. Non-limiting examples of heating means include peltier devices, contact with a hot gas or fluid, photon beams, lasers, infrared radiation, or other forms of electro-magnetic radiation. The heating means 619 is preferably a simple and inexpensive resistive heater such as a surface mount resistor. The comprehensive heating system 622 may also include an optional cooling means 620 to provide cooling of the heating system 622. In some embodiments, optional cooling means 620 can be one or more fans or blowers. Furthermore, in some embodiments, optionally, one or more external sensors 621 may be in thermal communication with the heat spreader 313. These sensors 621 may provide a measure of the temperature of the heat spreader 313 and an estimate of the temperature in the melt analysis region 206.

Figure 7:
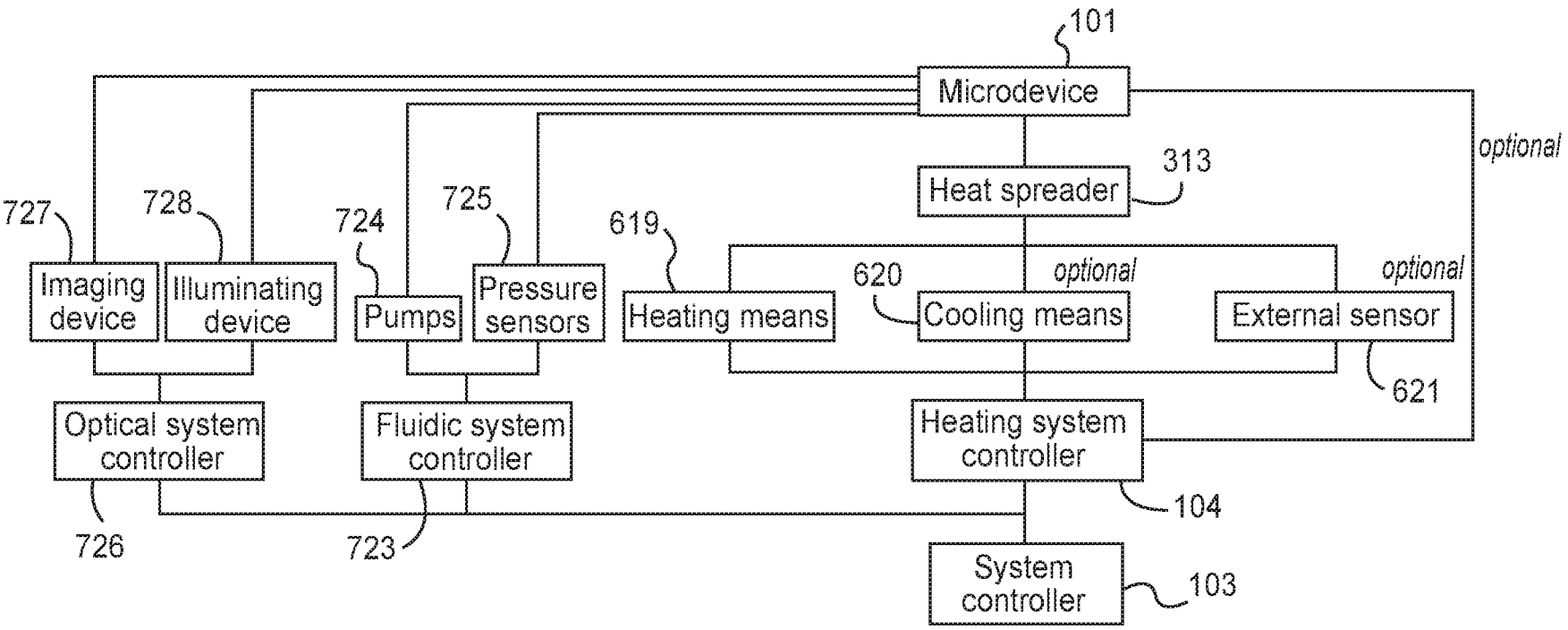
FIG. 7 is a system diagram.

In another embodiment, the comprehensive heating system 622 may include a heating system controller 104 to control the heating and temperature sensing. Further, the comprehensive heating system 622 may include optional configurations to allow for communication between the heating system and sensors 212 embedded on the microfluidic device 101 itself. The comprehensive heating system 622 may also include, in one embodiment, a system controller 103 that controls the heating system controller 104 as well as any other systems that may be utilized in conjunction with the microfluidic device 101, as shown in FIG. 7.

Specifically, fluid control and optical control systems may be required to perform melt analysis. The system controller 103 may control other aspects of the microfluidic device that are not directly related to melt analysis such as sample preparation and polymerase chain reaction (PCR) or any other functions that may be included on the microfluidic device.

In one embodiment, the optical system includes devices for illuminating 728 the microfluidic device and the samples it contains. The optical system also includes an imaging device 727 which collects intensity data based on fluorescence emissions from the samples on the microfluidic device. The fluidic system may include pumps 724 and pressure control elements 725 to actuate and control any fluid flow on the microfluidic device. The system controller 103 may create one or more melt curves or thermal property curves using the thermal/optical data it collects from the thermal/optical systems it controls.

FIG. 3 additionally depicts an embodiment of the present invention wherein a recess 314 is created in the heat spreader 313. The recess 314 may be formed in heat spreader 313 by any method known to those of skill in the art. In one non-limiting embodiment of the present invention, an encapsulated thermistor 316 can be provided on the heat spreader 313. In a preferred embodiment, the encapsulated thermistor 316 is placed within the recess 314. In a further embodiment, the recess 314 that may be backfilled with a thermally conductive material such as a conductive epoxy or other material known in the art. The encapsulated thermistor 316 will function as a temperature sensor, and due to its placement within the recess 314, the thermistor 316 will be able to accurately sense the temperature of the heat spreader 313 while reducing heat losses. In a non-limiting embodiment of the invention, the thermistor 316 can be replaced by other temperature sensors known to those of skill in the art, and thus the present application should be read such that thermistor 316 is interchangeable with temperature sensor 316. In some embodiments, insulation such as foams with high air content or other suitable materials may be added to the outside of the heating system to limit heat losses and ensure good agreement in temperature between the sensing element (s) 316 and the heat spreader 313.

FIG. 3 additionally illustrates the placement of a film resistor 317 on the heat spreader 313 to provide heat. One of skill in the art will recognize that alternate heating sources such as those described in the present invention may be substituted for the film resistor 317, and therefore the present application should be read such that film resistor 317 is interchangeable with heater 317. In some non-limiting embodiments, a passivation layer 315 is provided on the heat spreader 313 prior to attachment of the heater 317. The passivation layer may be utilized to prevent an electrical short between the heater 317 and the heat spreader 313. In one embodiment, a simple layer of black paint may be sufficient to prevent a short. In another embodiment, other suitable passivation materials as described herein may be used.

Figure 8:
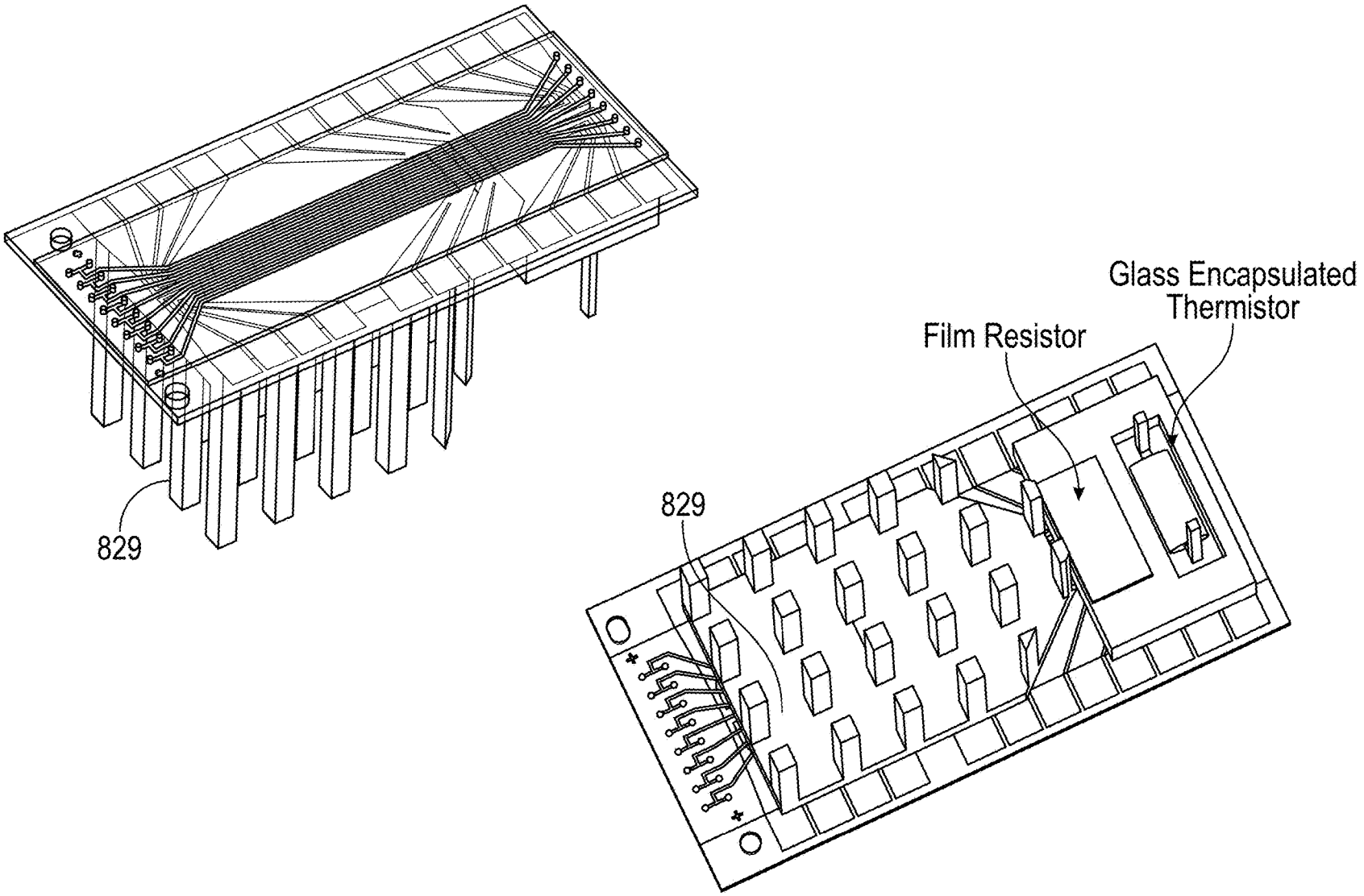
FIG. 8 is CAD drawings of a top and bottom view of a microfluidic chip with heat spreader and heat sink.

CAD models of a microsystem embodying aspects of the present invention are shown in FIG. 8 as both top and bottom views. This exemplary system is designed for PCR followed by high resolution melt analysis and is similar in some aspects to the systems described in those patents and patent applications incorporated by reference into the present application. The system includes a microfluidic device 101 that features a plurality of microchannels 202 and a plurality of electrodes 210, 211 to control and measure properties associated with the microchannels 202. In this example, the embedded electrodes 210, 211 in the melt region are used as temperature sensors to determine the sample temperatures for melt analysis. A heat sink 829 is permanently affixed to the upstream portion of the device to provide additional cooling for the PCR portion of the device. A copper plate heat spreader 313 is permanently affixed to the downstream portion of the device in the melt region. In this illustrative embodiment, a film resistor 317 and encapsulated thermistor 316 are included on the heat spreader 313 to provide heat and sense temperature, respectively.

Figure 9:
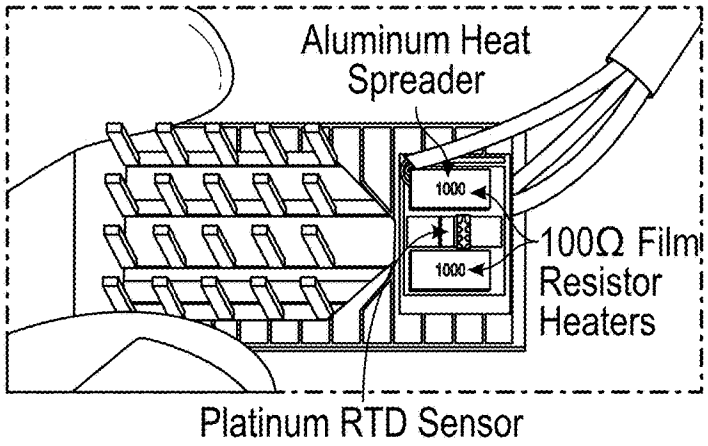
FIG. 9 depicts a microfluidic chip according to one embodiment.

In another non-limiting embodiment, a prototype embodying some aspects of the present invention is shown in FIG. 9. In this prototype an aluminum plate heat spreader 313 is permanently affixed to the glass microchip, two film resistors 317 are used for heating and a single resistance temperature detector (RTD) 316 is used for temperature sensing. This heating system features two lines of symmetry (ignoring the leads). This non-limiting embodiment demonstrates that more than one heater and/or more than one temperature sensor may be utilized on in conjunction with the heat spreaders 313 of the present invention.

Figure 10B:
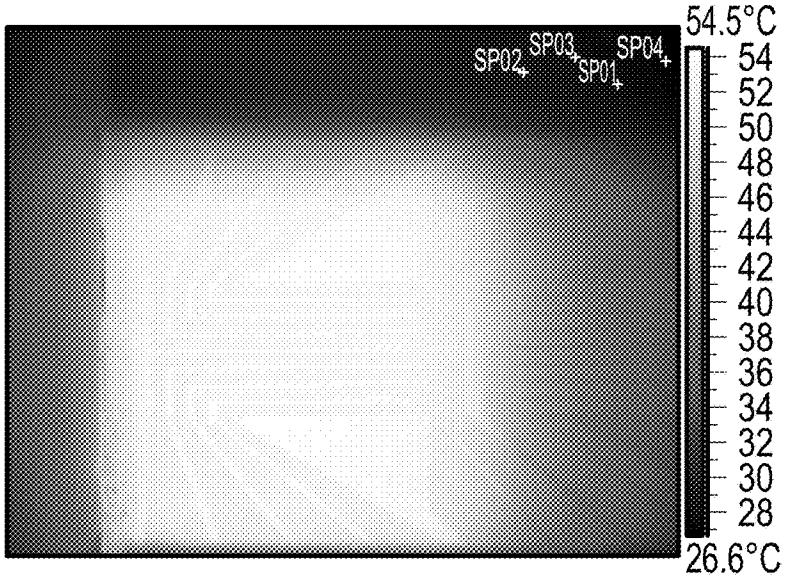
FIG. 10B is a thermal photograph depicting the area of a microfluidic chip in thermal contact with a heat spreader.
Figure 10A:
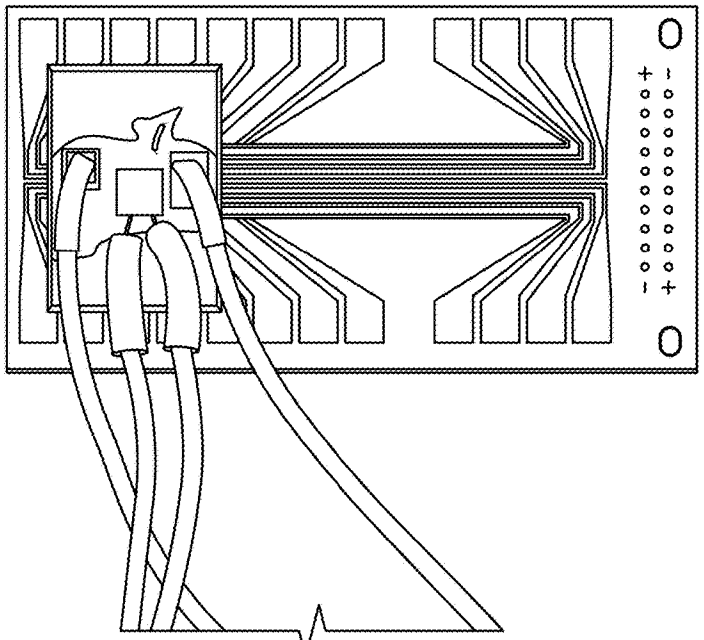
FIG. 10A depicts a microfluidic chip according to one embodiment.

Another prototype embodying some aspects of the present invention is shown in FIG. 10A. This prototype features a single heater 317 and again features two lines of symmetry (ignoring the leads). The thermal image shown in FIG. 10B demonstrates the temperature uniformity achieved by the area of the microfluidic device 101 in thermal contact with the heat spreader 313.

Figure 11:
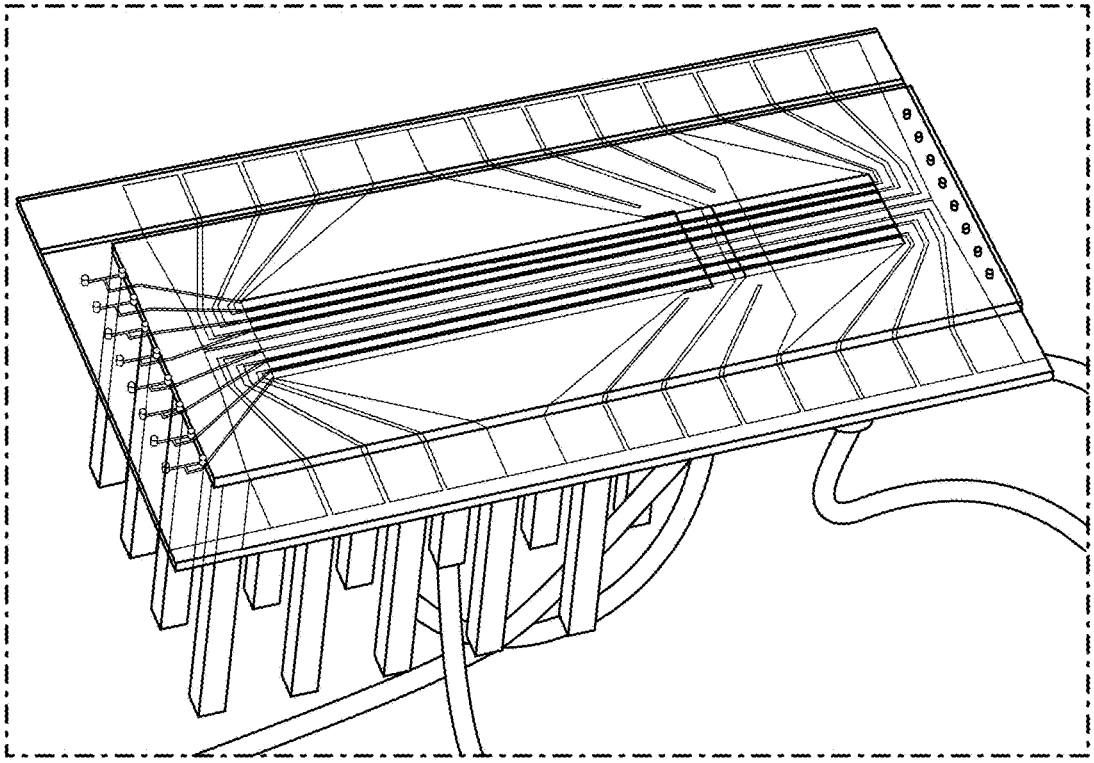
FIG. 11 depicts a microfluidic chip according to one embodiment.

The methods and systems described herein, including the heat spreading devices and interconnection materials discussed here, may be used on a stand alone melt analysis platform. However, they may also be combined with other processes and systems including but not limited to sample preparation, DNA extraction, DNA amplification, and PCR. The heat spreading devices and interconnection materials discussed may be included on a microfluidic platform (FIG. 11) that performs DNA amplification (e.g., PCR) followed by thermal melting analysis. In this illustrative embodiment, a plurality of patient samples can be processed at the same time in parallel. DNA in samples may be amplified in the PCR zone and then melted shortly thereafter in the melt analysis region. Genotypes of the sample may be determined using the improved melt analysis system. In this configuration, only one instrument is required for both amplification and analysis. Further, the PCR portion of the device may be used to amplify controls that are used to calibrate the melt portion of the device as described herein. The microscale of this device allows for rapid heating and cooling which ensures that processing time is minimized. The large area of thermal uniformity created by the heat spreader and interconnection materials ensure that each of the parallel microchannels can be used for melt analysis with high reproducibility.

The present invention also relates to melt analysis methods as described herein, which are based on a disposable microfluidic platform which provides a great advantage in terms of cost and throughput. The methods described enable highly reproducible melt curves to be created because uniformity and consistency are ensured. The prior art has not addressed reproducibility of melt analysis on microsytems or the reproducibility problems that exists due to temperature transients. Embedded sensors provide an ideal solution to the dynamic temperature response problem. Furthermore, the control/calibration methods utilize the uniformity and embedded sensors to provide an even greater enhancement to the quality of the melt analysis. The present invention further details control methods for a melting system that individually and in combination result in improved melt results (and improved genotyping on systems designed for that purpose).

Figure 13:
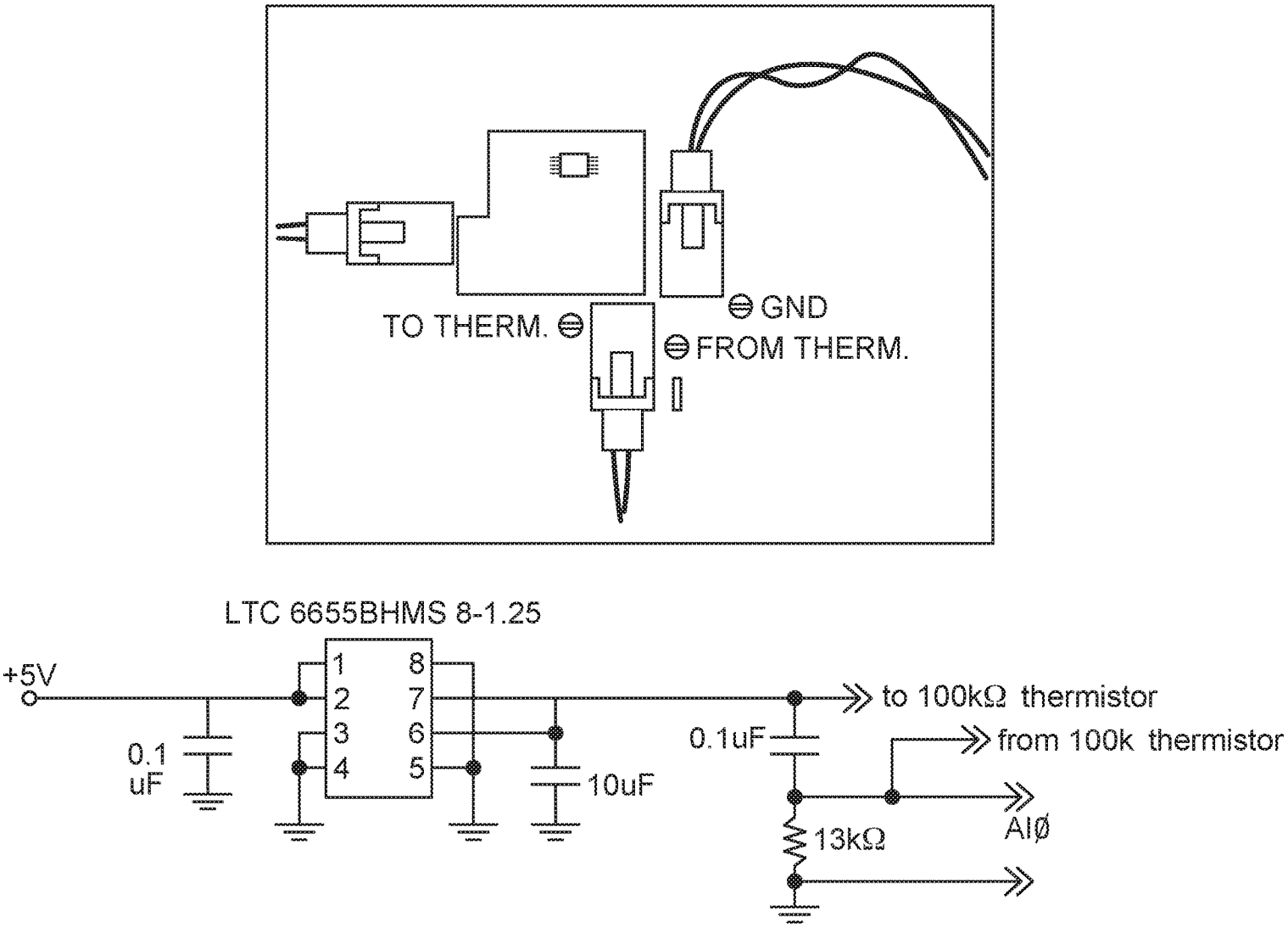
FIG. 13 depicts a circuit for controlling a thermistor.

Also, optionally, in one embodiment, the heating system of the present invention may include one or more external sensors in thermal communication with the heat spreader. In some embodiments, the one or more external sensors are permanently attached to the microfluidic device or the heat spreader. These sensors provide a measure of the temperature of the heat spreader and an estimate of the temperature in the melt analysis region. In one non-limiting embodiment, the sensors 316 may be controlled by the system controller 103 or the heater control 104 via a circuit such as that illustrated in FIG. 13.

It is a further embodiment of the present invention that the system further comprises a heating system controller to control the heating and temperature sensing. Optionally, the heating system controller may communicate (control and receive signals from) with sensors 212 embedded on the microfluidic device 101 itself such as those shown in FIG. 2. These embedded sensors may be used for temperature measurement of the melt zone or may be used to sense the time at which heat arrives at the melt zone.

Figure 12:
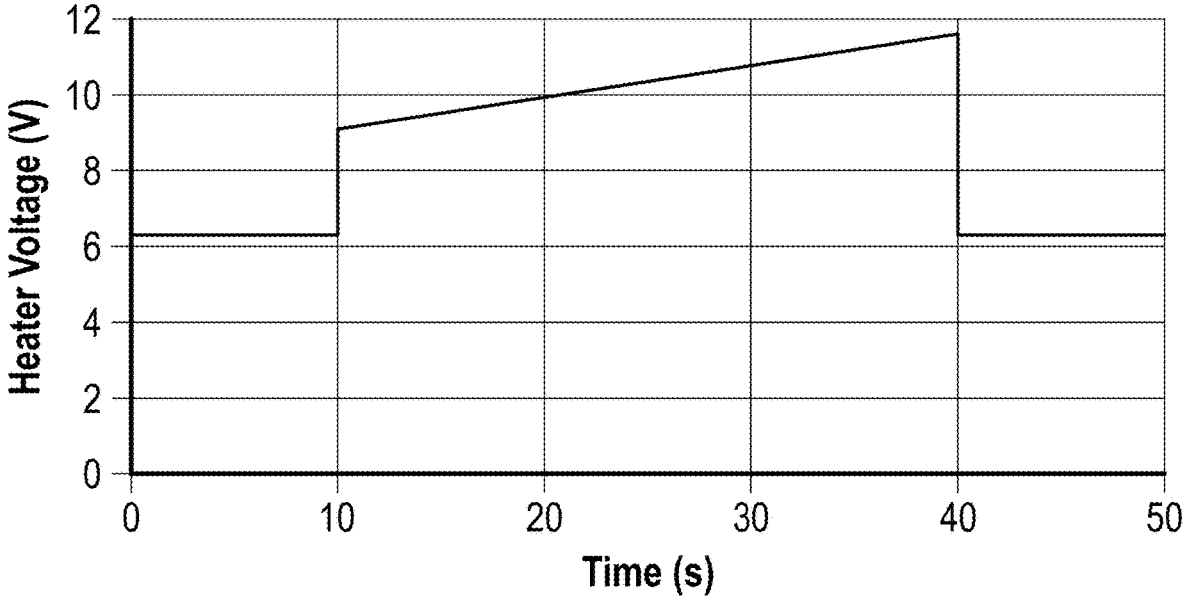
FIG. 12 is a graph of heater voltage (V) vs. time (s).

The present invention also provides that the heating system controller may control and receive signals from heating means, cooling means (e.g., fans and blowers), and any sensors used to determine the temperature in the melt region or on the heat spreader. The heating means may be controlled using any standard control scheme known in the art including but not limited to proportional integral derivative (PID), on/off, or pulse width modulated (PWM) control. The heating means may also be driven in "open loop" mode in which heat is provided at a predetermined rate rather than at a rate determined by feedback control. One method of open loop control is to step and ramp the heater voltage as shown in FIG. 12. These open loop methods are advantageous because by giving the heater a smooth input voltage, it is ensured that the temperature of the heat spreader increases smoothly, resulting in a higher quality (lower noise) melt curves. Further, the one or more temperature sensors (embedded or external) may be used in a calibration step to generate a smooth heating profile that can be run open loop. To create this smooth calibrated profile, first feedback control can be used to determine the approximate power (or heater voltage) required to create the desired temperature profile. The power (or heater voltage) can be fit, using curve fitting techniques known to those of skill in the art, to a predetermined model (such as the step and ramp model, for example). Then, the fitted heater power or voltage profile can be used to create a smooth heating profile without the unwanted noise created by a feedback controller.

To promote thermal uniformity in the melt region 206 and reduce power requirements for the heating means, it is an embodiment of the present invention that various methods may optionally be used to control the cooling system. One exemplary cooling system control method is the inclusion of physical barriers or baffling that prevents air currents from directly impacting the heating system. Physical barriers that prevent airflow from impacting the heating system result in decreased heat losses, which lower thermal gradients. With lower thermal gradients there is better uniformity of temperature in the melt analysis region, and the temperature of any external sensors are in better agreement with the temperature of the samples being melted. Another cooling system control method includes pulse width modulation (PWM) of any cooling fans/blowers. Alternatively, other control mechanisms known to those of skill in the art could be used. Fans and blowers may be included to hasten the cool down after melt analysis or may serve other system functions not directly related to melt analysis such as promoting fast cooling for PCR. In one embodiment, PWM could be used to limit airflow over the heating system for melt analysis for the reasons described above, namely reducing heat losses and promoting uniformity. In another embodiment, a high duty cycle (DC) for rapid cooling could be used when the device must be cooled such as after a melt. A low DC to limit the airflow could be used when the device must be heated such as during the melt.

Some embodiments of the present invention may include external sensors as described above. These may be used to sense the temperature or temperatures within the melt region 206 or may be used to control the heat spreader 313 or may do both. External sensors may be contact or non-contact in nature including RTDs, thermistors, diodes, other semiconductor devices, thermocouples, pyrometry, thermal reflectance, or other devices/methods known in the art. The external sensor is preferably matched to the microfluidic device with respect to its dynamic thermal response. Since heat must travel from the heating means to both the melt region and the external sensor it is preferable that heat arrive at both places at the same time. To ensure good transient agreement between the sensor and the melt region the heat capacitances of the sensor and the microfluidic device must be matched.

Specifically, the mass times the specific heat capacity of the two should be approximately equal (m1*cp1~m2*cp2). The more closely the two are matched the better the transient agreement will be. Furthermore, care must be taken to place the sensor and microfluidic device at a similar distance from the heating means. Care must also be taken in the selection of the bonding and potting materials as these relatively low conductance materials may contribute to dynamic disagreement. For example, to match a glass microfluidic device featuring embedded metallic sensors, a glass encapsulated thermistor also featuring a metallic sensor element of similar size may be used to match the heat capacitances.

In some embodiments, temperature in the melt region for melt analysis is sensed by one or more elements on the microfluidic device itself rather than reliance on an external sensor. Optionally, an external sensor may still be included in the heating system to control the heating means. An example of a device including sensing elements on the microfluidic device is shown in FIG. 2. In this non-limiting example, eight thin-film platinum sensors (RTDs) underlie eight patient microchannels that contain the samples to be melted. The sensors in this example are underneath the microchannels and are covered by a thin glass passivation layer that prevents the samples for coming into direct contact with the sensors. The passivation layer prevents a source of contamination as metals are known to react with biological samples. Further, the passivation may prevent electrolysis of the samples as it electrically isolates currents in the sensor from the samples. Other passivation materials include but are not limited to silicon dioxide, silicon nitride, silicon, polysilicon, parylene, polyimide (e.g., kapton), and benzocyclobutene (BCB). Other sensor-to-sample configurations are contemplated such as sensors that are on the sidewalls of the microchannels or located between sample reservoirs/channels. Locating the sensors in such immediate proximity to the channels (on the microscale) has advantages in terms of accuracy and reproducibility since they are less impacted by heat losses. A variety of sensors could be used including but not limited to capacitive, resistive, semiconductor devices, and thermocouples. The embedded sensor configuration including thin-film RTDs described here is preferred because it is easy to fabricate and highly reproducible.

In one embodiment, one or more sensor elements embedded on the microfluidic device may also be used to calibrate the dynamic response of an external sensor. In reference to the above discussion of the transient agreement of temperature between the sensor and the melt region, the embedded sensors may be used to determine any thermal delay that may exist between the sensor and the melt region on the microfluidic device. In this configuration, the embedded sensors may not need to be accurate in measuring temperature if the accurate temperature measurement for melt analysis is to be made with the external sensor. However, the embedded sensors must accurately measure the time the heat arrives so that the temperature profile measured at the sensor can be transformed into a temperature profile experienced by the samples melted on the microfluidic device. Alternatively, the embedded sensors may be used to measure the temperature for melt analysis and the calibration step may be used to improve the control of the heating means which may be controlled using the external sensor.

Care must be taken to read any embedded sensors without adding unwanted heat to the samples. This problem is commonly referred to as self-heating. To reduce self-heating, the embedded sensors should be excited with low voltage/low current. For example, the sensors may be read using a high resistance sense resistor in a voltage divider circuit. The high resistance sense resistor limits the current through the sensor element and reduces unwanted self-heating. In one non-limiting embodiment, ~30 ohm embedded RTD sensors are used with a 2.7 kohm sense resistor and a 1.5V power supply. The power dissipation in this example at the sensor is only 9 microwatts, which is a negligible amount of heat.

In some embodiments, the external sensor requires calibration to meet the accuracy requirements of the device. This calibration may be done in the instrument that processes the melt analysis or may be performed prior to usage of the microfluidic device.

In some embodiments, the one or more external sensors can be used without calibration by including "disposable" or "interchangeable" sensors that are manufactured to achieve a specified tolerance without any additional calibration. Both "point match" and "curve tracking sensors" may be used. Point match sensors are specified to be accurate within a specified tolerance at a specific temperature point. Curve tracking sensors are specified to be accurate within a specified tolerance at all temperatures between two points (e.g., +–0.2° C. between 0-100° C. or +–0.1° C. between 0-70° C.). Suitable interchangeable thermistors are available from Honeywell and GE among others.

In some embodiments, the one or more external or embedded sensors may be calibrated by loading or flowing through a control whose melting properties are well known. By melting a control, the temperature in the melt region may be precisely calibrated. The control could be a wild type DNA, amplicon, oligonucleotide, or mixture of amplicons or oligonucleotides. The control could be based on human genomic DNA, DNA from another organism, or entirely synthetic. The control could also be a so called ultraconserved element (UCE) that is absolutely conserved between orthologous regions of the human, rat, and mouse genomes. The benefit of the UCE is that it is present and the same in all human genomic samples. The control may be used in one or more of the sample reservoirs/channels. The control may be run at the same time (utilizing parallelization) or prior to those melts run to analyze samples under test. The control may also be repeated to achieve reproducibility targets desired for the melt analysis. Note that aspects of the heating system described above that improve uniformity (such as cooling enhancements and thermally conductive heat spreader) make it possible to run a control in a channel that is different than the one under test. Specifically, a control can be run in one channel while an unknown sample is run in another because the innovative heating system ensures that both channels experience the same thermal profile because they are both located in the same large thermally uniform zone. Having a control in a separate reservoir/channel is an ideal configuration for a device featuring closely spaced parallel microchannels.

EXAMPLES

Thermal uniformity and stability of melt temperatures

Run Conditions and Cartridge Performance

The uniformity of temperature and the stability of the melt were assessed by running a 17 melt long panel on four microfluidic cartridges featuring the heat spreader and external heater. The panel alternated between UCE17 and the 2C9*3 assays (9 melts of UCE17 and 8 of 2C9*3 in total). Two assays were used to have some comparison between the stability and uniformity of the two different targets. Multiple melts of the same two assays was useful for determining statistics as well as drift over time.

PCR reagents (Blanking solution, DNA sample buffer, *3 primer, UCE17 primer, Polymerase, RFCal and CULS buffer) were automixed by the instrument. PCR was performed, followed by thermal melting. Conditions for the PCR and thermal melt were: 95° C. for 2 s including a 0.25 s ramp up transition; 55° C. for 1.5 s including a 0.25 s ramp down transition; and 72° C. for 6.5 s including a 6.5 s ramp up transition. Thermal melt conditions included a ramp from nominally 65° C. to 95° C. at 1° C./s.

The external temperature sensor was found to be offset in temperature compared to the platinum trace measurements. The offset varied from microfluidic cartridge to microfluidic cartridge but was the same for over time and over multiple channels for a given microfluidic cartridge. Temperature offset ranged from the thermistor reading between 7.5° C. to 11.7° C. cooler than the calibrated Pt traces.

This offset was believed to be related to the cooling airflow which impacts the heat spreader and leads of the thermistor. The external temperature sensor can still be used to control the temperature ramp and detect melts, but the melt range and temperatures measured will be offset compared to the Pt trace measurements.

Uniformity of Temperature

Figure 14:
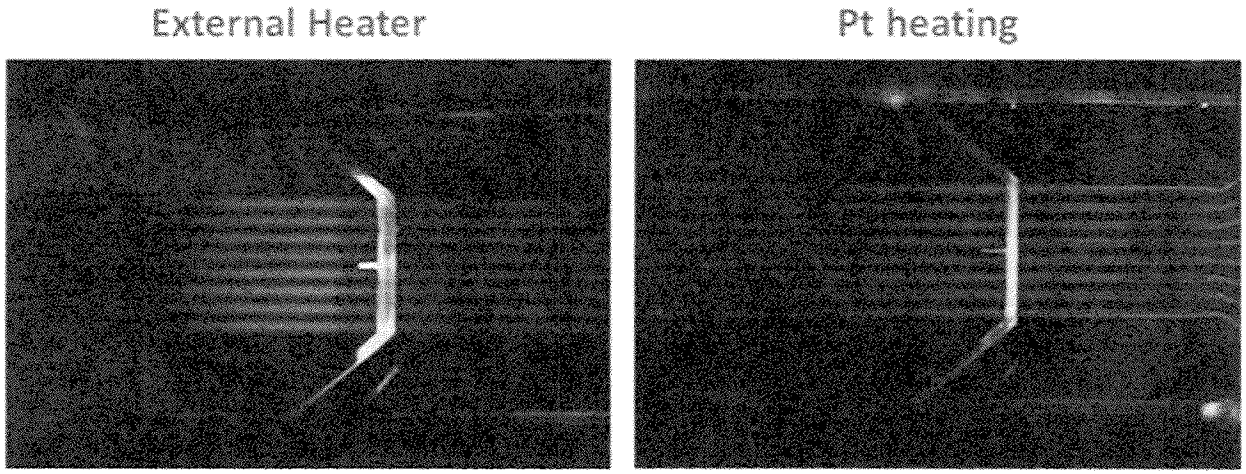
FIG. 14 depicts fluorescence intensities in zone 2 during calibration.

During the PCR and thermal melt runs described above, it was observed that the external heater appeared to melt much more uniformly than the controls run in cartridges not having the external heater. The platinum (Pt) trace heating used in non-external heater cartridges resulted in a large temperature gradient which was noticeable when the amplicon melts first in the center of the melting zone (zone 2). Channels 1 and 8 were observed to melt from the inside of the channel first in those cartridges with platinum trace heating. These effects were absent in the external heater cartridges since the copper plate effectively equalized the temperature across the entire zone 2. The result of this improved uniformity of temperature was that the melt curves on the external heating system were sharper than those on the traditional system. Furthermore, with the external heater, there was no difference between the melts from interior or exterior channels. FIG. 14 shows the calibration check melt (using standard calibration method described in U.S. patent application Ser. No. 13/223,258 and U.S. patent application Ser. No. 13/223,270) for zone 2 for all eight cartridges run. The external heater melts were better aligned than those made with the traditional cartridge. Furthermore, all of the traditional cartridges exhibited a distorted melt curve for channels 1 and 8 in comparison to channels 2-7, and none of the external heater cartridges exhibited this behavior. FIG. 14 demonstrates that fluorescence intensities decreased at the same time throughout Zone 2 with the external heater, indicating uniformity of temperature. In contrast, with platinum trace heating, a noticeable hotspot is evident in the center of the traces. The temperature gradient in the Pt trace heating is particularly a problem for channels 1 and 8, which are cooler on the outside than on the inside.

Figure 15A:
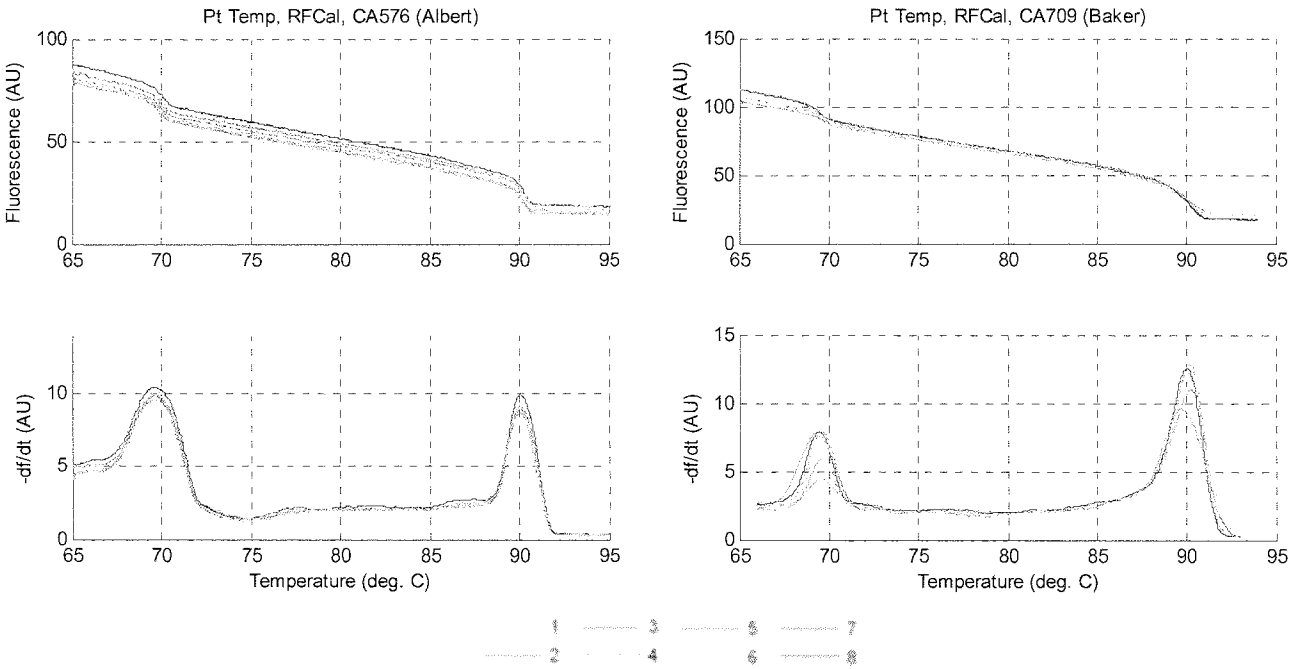
FIG. 15A-15B are graphs depicting fluorescence vs. temperature or the derivative curve obtained during a calibration check for zone 2.
Figure 15B:
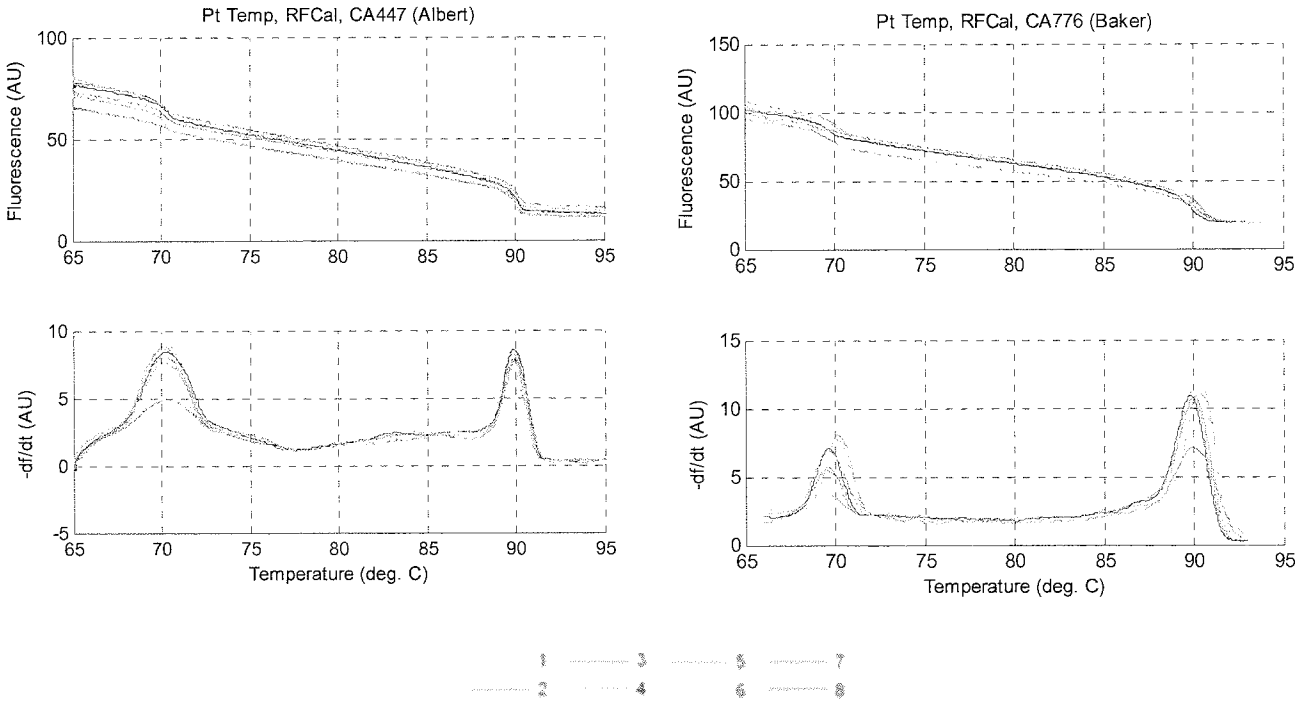

FIGS. 15A and 15B depicts the result of the 1calibration check for Zone 2 with (left) and without (right) the external heater system. With the external heater, melts are better aligned and exterior channels behavior similar to interior channels. In contrast, the channels 1 and 8 have a different melt shape with a traditional cartridge (this is most evident in the derivative curve of the high temperature feature: outside channels have lower and broader peaks).

Figure 16A:
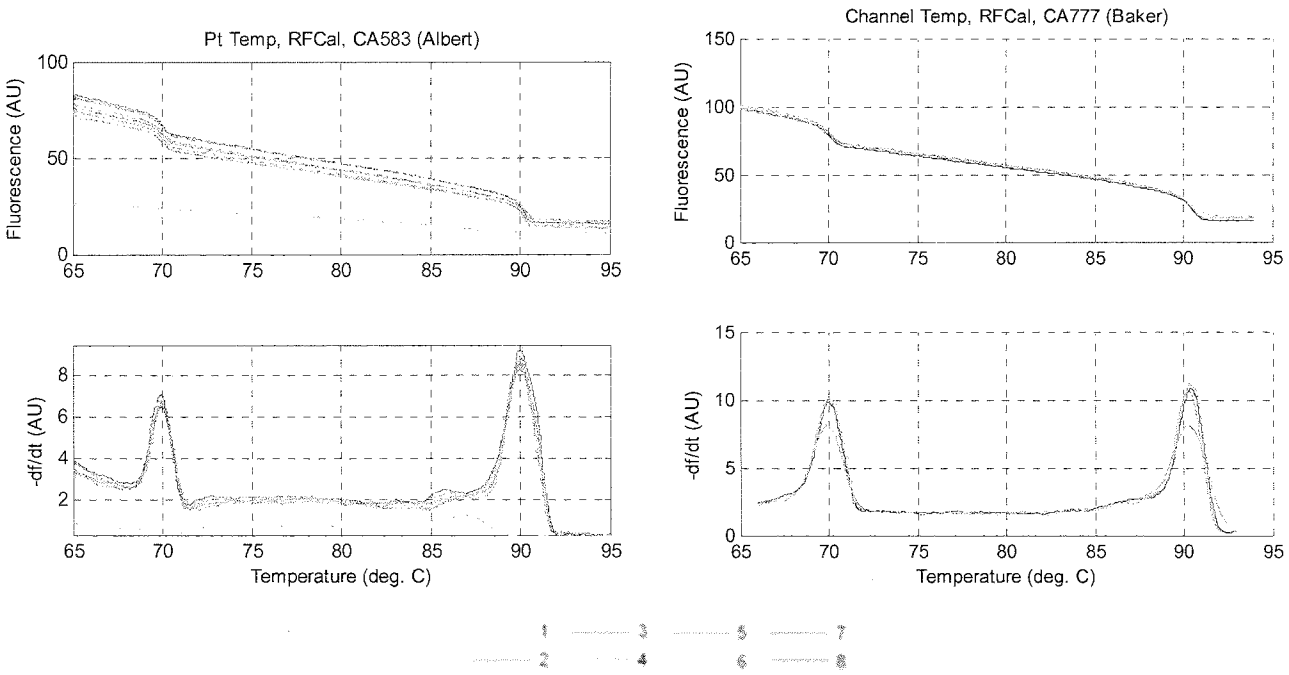
FIG. 16A-16B are graphs depicting fluorescence vs. temperature or the derivative curve obtained during a calibration check for zone 2.
Figure 16B:
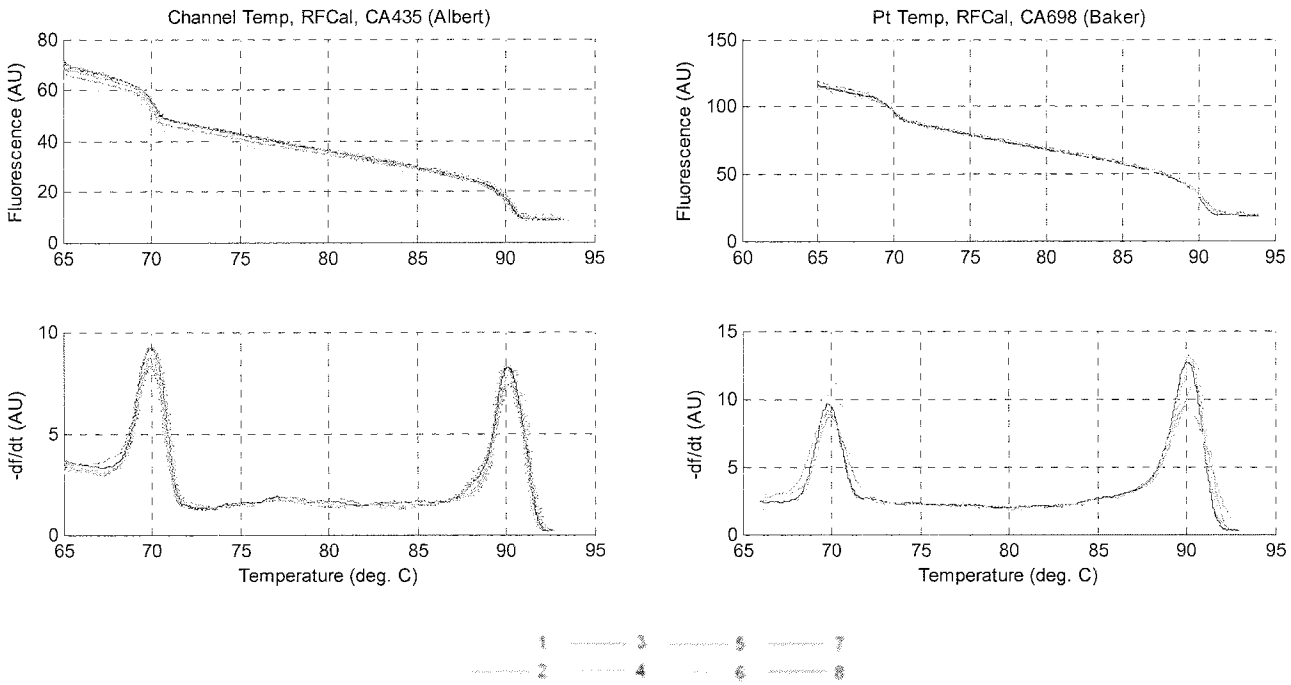

FIGS. 16A and 16B depicts the result of the 2calibration check for Zone 2 with (left) and without (right) the external heater system for a second set of cartridges. Again, it was seen that with the external heater, melts are better aligned and exterior channels behavior similar to interior channels. In contrast, the channels 1 and 8 have a different melt shape with a traditional cartridge (this is most evident in the derivative curve of the high temperature feature: outside channels have lower and broader peaks).

Figure 17:
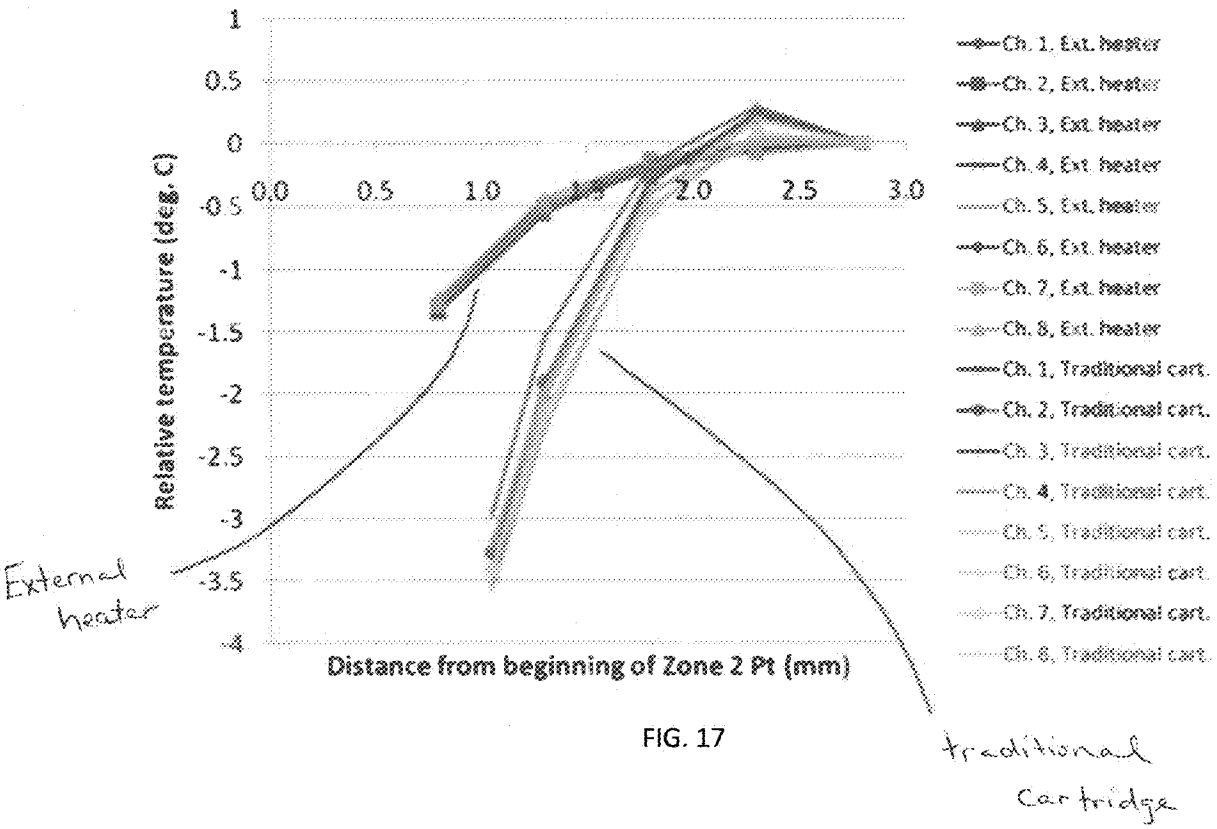
FIG. 17 is a graph of relative temperature vs. distance from the beginning of zone 2.

Another measure of uniformity was made by using the image data from the calibration checks in which the channels were completely filled with amplicon. By comparing when the melt occurred in regions of interest (ROIs) placed along the length of a given channel (FIG. 17), the relative temperature distribution was determined (i.e., the amplicon melts first in the hottest regions). FIG. 17 shows the relative temperature distribution for an external heater cartridge compared to a traditional cartridge. The distribution is based on the Tm of the RF200 peak in the RFCal amplicon (this is the higher temperature feature). The lengthwise uniformity was substantially improved with the external heater. The external cartridge is uniform to within 0.2° C. (max-min) in the center 1 mm measured lengthwise. The cartridge used were CA-576 (Ext. heater) and CA-709 (Traditional).

Melt Results

Figure 18A:
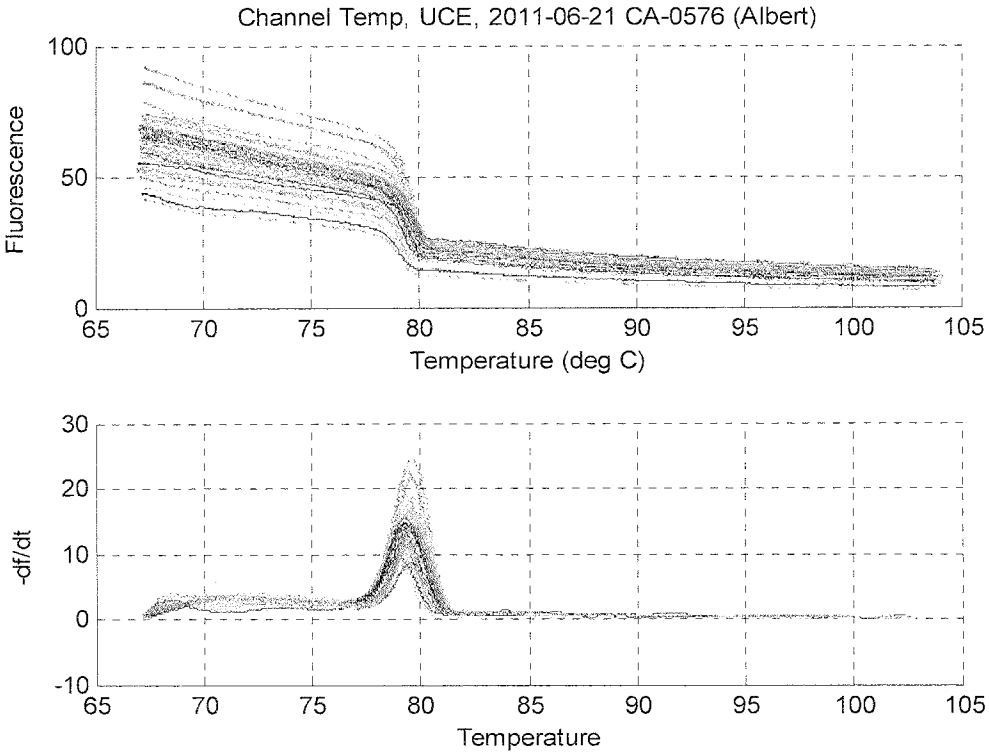
FIG. 18A-B depicts melt profiles and normalization plots.
Figure 18B:
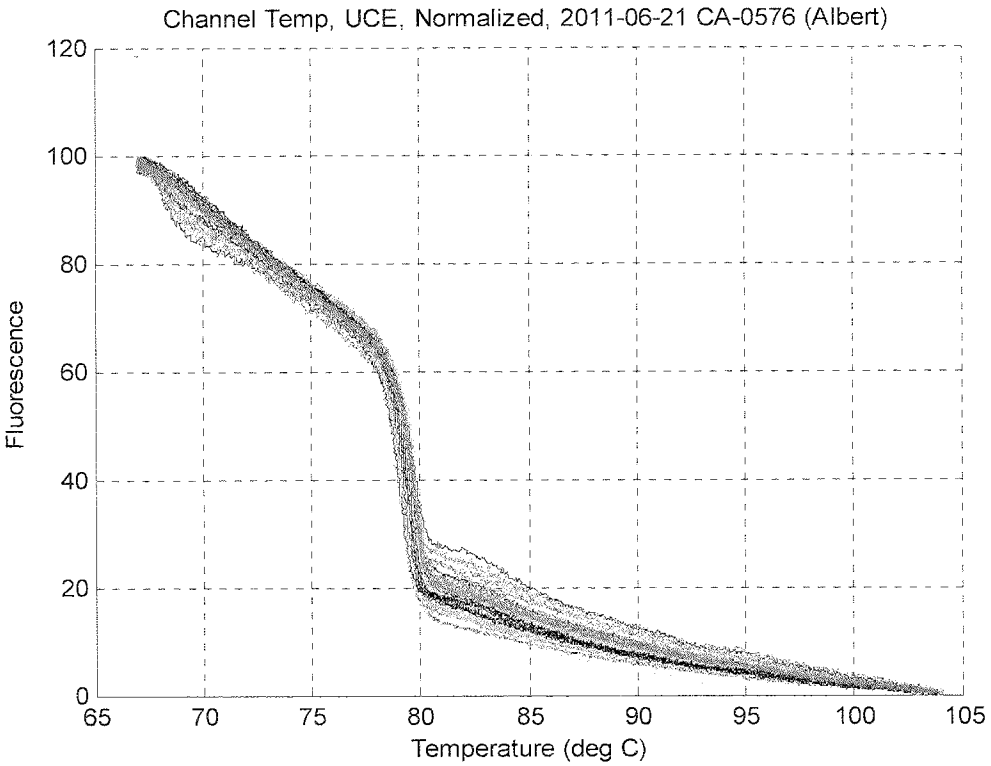
Figure 19A:
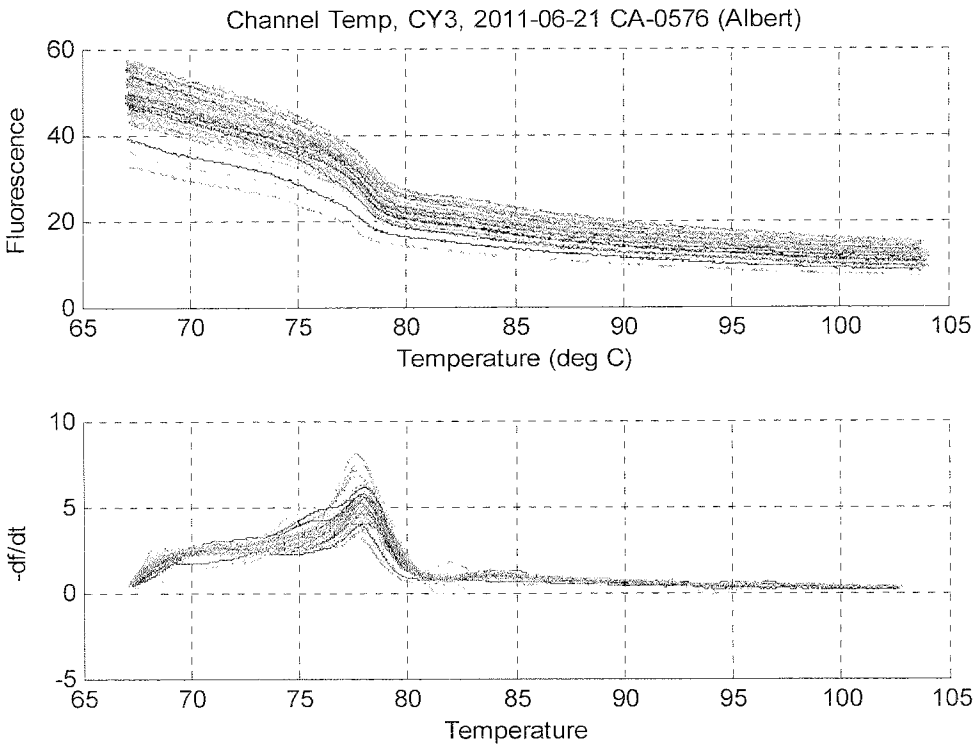
FIG. 19A-B depicts melt profiles and normalization plots.

Representative melt results for the external heating system are shown in FIG. 18A-B and FIG. 19A-BFIG, which show all of the UCE17 and *3 melts obtained during the entire panel for the external heater cartridge identified as CA-0576. Therefore, FIG. 18A-B and FIG. 19A-B show all 72 UCE17 melts and all 64*3 melts, respectively. Melting temperatures (Tm's) were calculated by determining the maximum in the negative derivative curves. The normalization plots (setting the maximum to 100 and the minimum to 0) better show the tight grouping of the melts, which demonstrates repeatability of the melt results.

FIG. depicts UCE17 melt profiles based on the platinum trace temperature measurements for CA-0576. The derivative curves are based on a 2° C. Savitsky-Golay filter window. The normalization plot (setting the maximum to 100 and the minimum to 0) better shows the tightness of the melts.

Figure 19B:
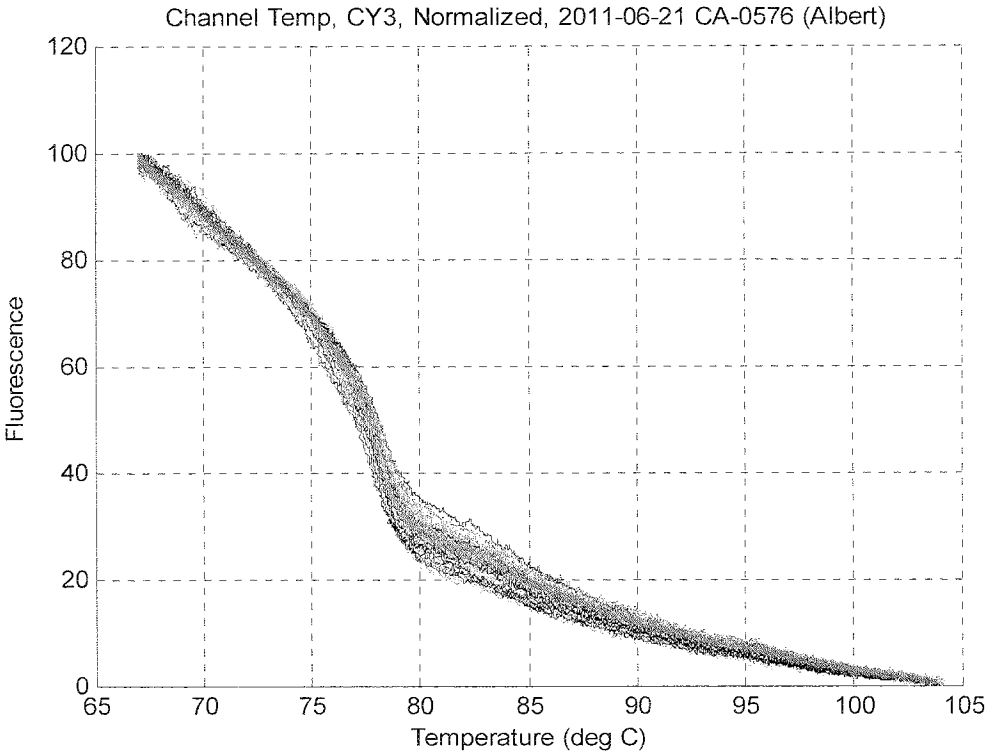

FIG. 19A-B depicts *3 melt profiles based on the platinum trace temperature measurements for CA-0576. The derivative curves are based on a 2° C. Savitsky-Golay filter window. The normalization plot (setting the maximum to 100 and the minimum to 0) better shows the tightness of the melts.

Channel to Channel Variation in Tm

Tm's were calculated for each channel using two different independent methods: 1) each channel used its own Pt trace, which was calibrated using the RFCal amplicon; or 2) all channels' Tm's were based on the single external thermistor. The two methods operate on different physical principles (thin-film resistor vs. semi-conductor) and were measured by different circuits (AMAP card vs. breadboard circuit).

The advantage of method one was that the eight Pt traces are so close to the fluidic channel that they provide the best estimated measure of the actual channel temperature. However, the Pt traces required calibration with a specific RFCal amplicon and the presence of eight different sensors can potentially lead to increased error as each sensor may have its own error.

The advantage of method two was that the external sensor was a single pre-calibrated element. Therefore, if variations in Tm were observed from channel to channel, they were due to non-uniform heating or true variations in melt temperature (i.e., the amplicon in different channels melted at different temperatures).

The channel to channel variation was determined using UCE17 melts and the platinum trace temperature measurements. The average channel to channel variation in Tm (calculated by determining the standard deviation in Tm's across channels for each individual melt and then averaging all the standard deviations for all melts in the panel) was 0.19±0.06° C. (SD, n=38) for the external heater. The average channel to channel variation in Tm was 0.22±0.05° C. (SD, n=36) for the non-external heater control cartridges.

The channel to channel variation was investigated by plotting the Tm's as a function of channel number (FIG. 20A-D). The Tm's determined with the eight Pt trace measurements were in good agreement with the independent external sensor measurement. However, the distribution of Tm's was different for the two assays. Moreover, since the panel alternated between the two assays, the distribution in Tm's was observed to alternate. The variation in Tm from channel to channel appeared to be unrelated to the temperature measurement (because the two independent methods are in agreement) and unrelated to uniformity of temperature (because uniformity should not alternate between different distributions).

Figure 20A:
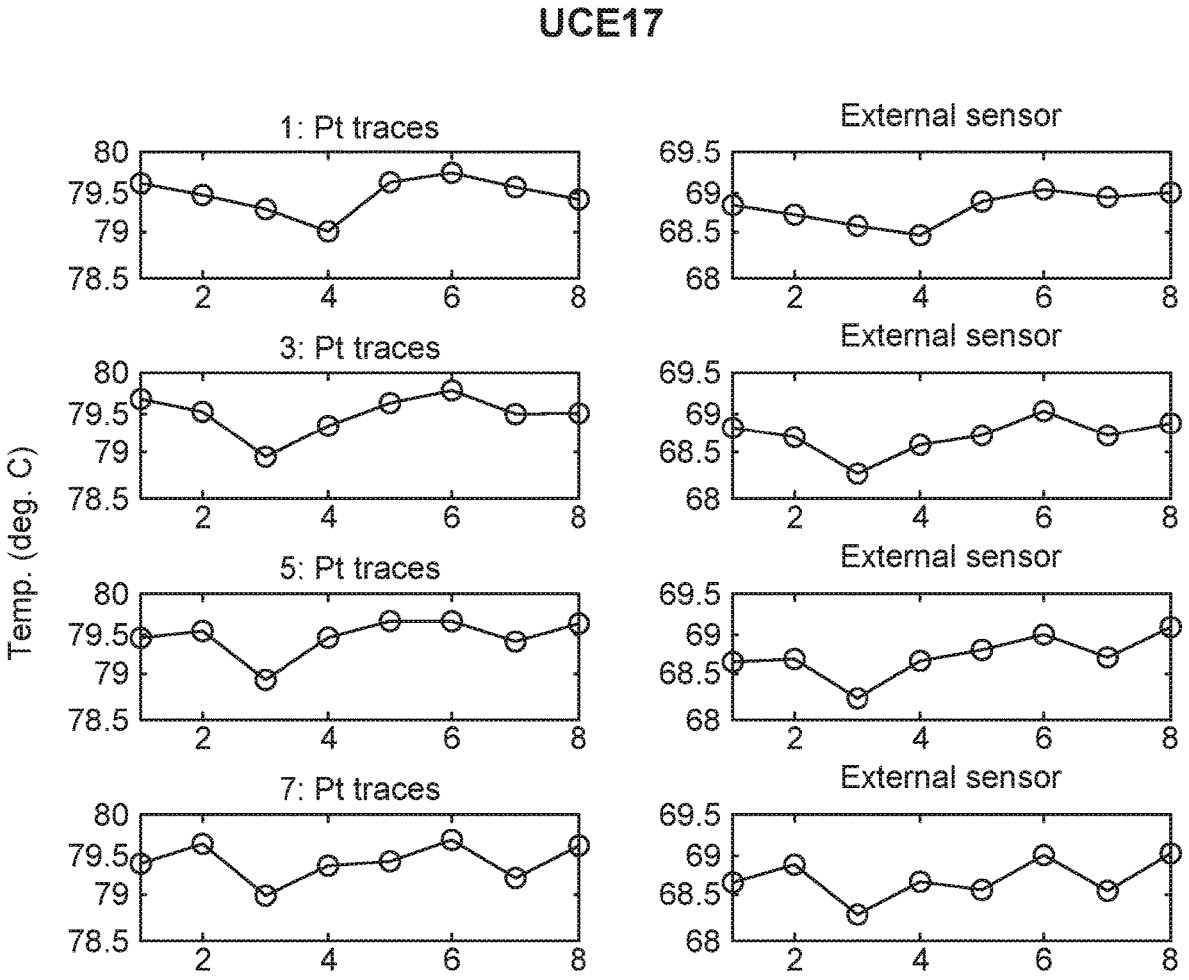
FIG. 20A-D depicts graphs of temperature vs. microfluidic channel number to show temperature differences between channels.
Figure 20B:
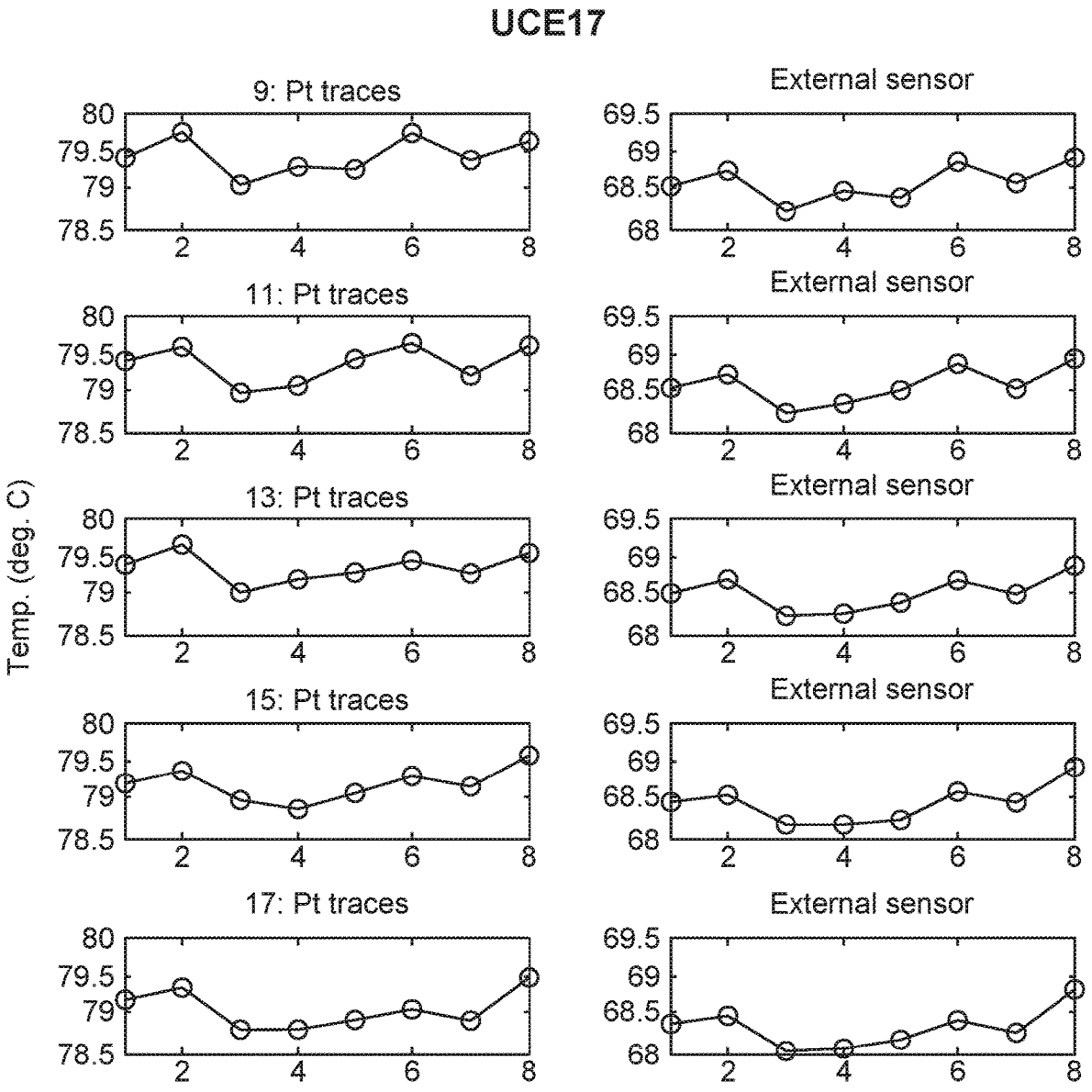
Figure 20C:
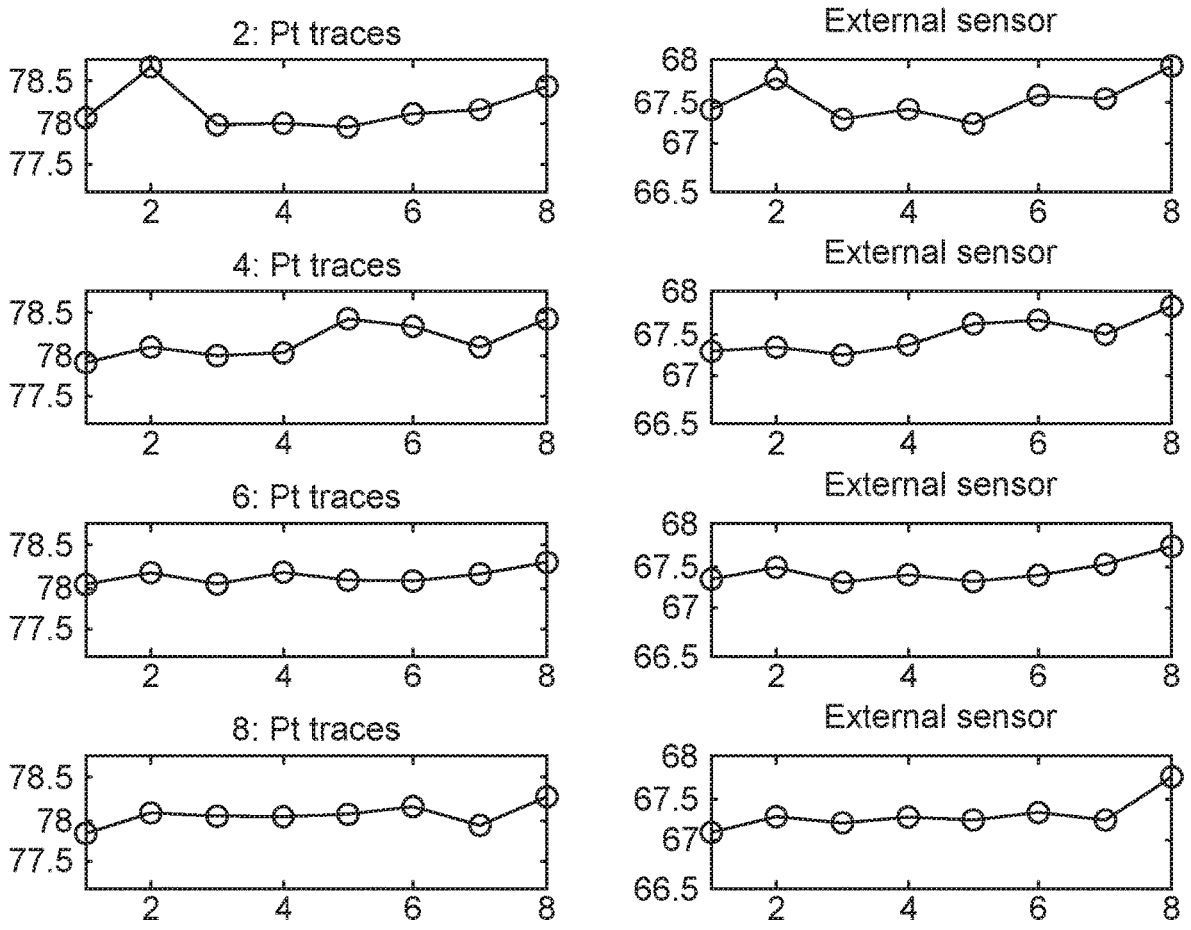
Figure 20D:
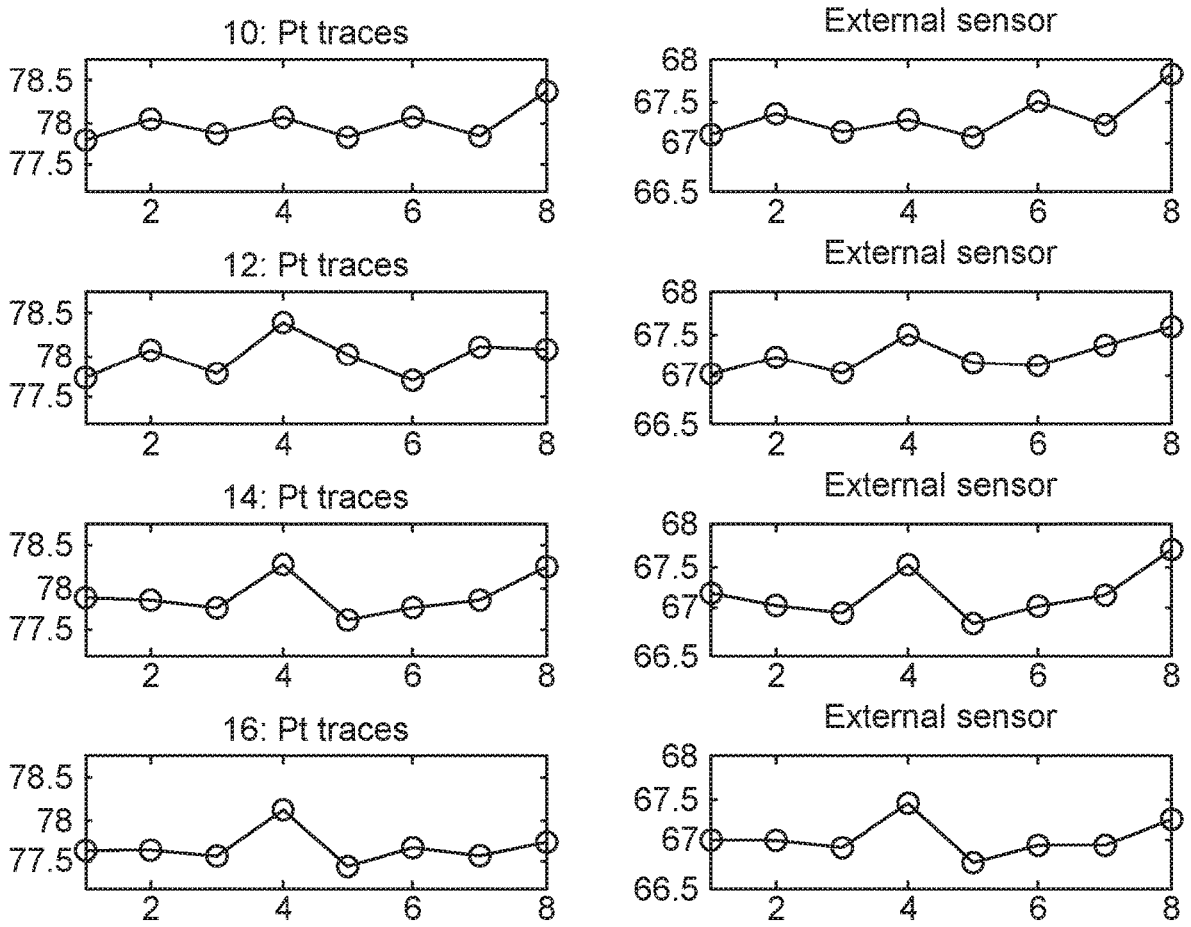

FIG. 20A-D depicts+the distribution of Tm's by channel for the 17 melt panel with the external heater. The odd melts (UCE17) are shown in FIGS. 21A and 20B and the even melts (*3) are shown in FIGS. 20C and 20D. The eight Pt trace temperature measurements (left columns of each Figure) are in good agreement with the external sensor measurement (right columns of each Figure). However, the distribution of Tm's was different for the two assays, and the distribution appears to alternate as the panel alternates between the two assays. The cartridge used in the experiments reported in FIG. 20A-D was identified as CA-0576.

The channel to channel variation was further investigated by performing a similar analysis with the non-external heater control cartridges. The control system lacked the $9^{th}$ independent temperature measurement (the external thermistor), but the distribution in Tm's was again observed to alternate as the panel alternated between the two assays. In one case a persistent "M" shape was observed in the Tm distribution in *3 melts 10, 12, 14, and 16 that were not present in the UCE17 melts 11, 13, 15, and 17.

Figure 21:
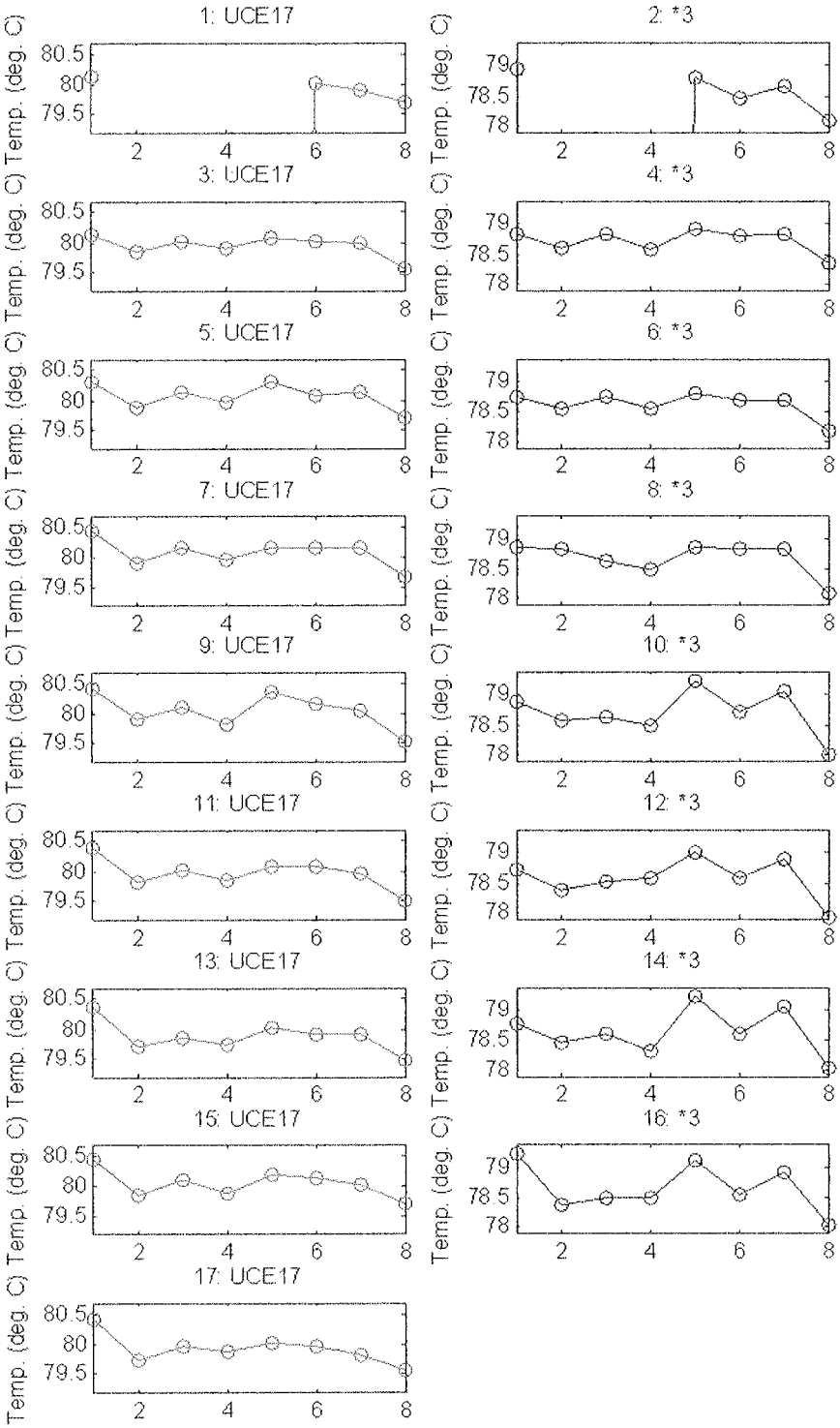
FIG. 21 depicts graphs of temperature vs. microfluidic channel number to show temperature differences between channels.
Figure 22A:
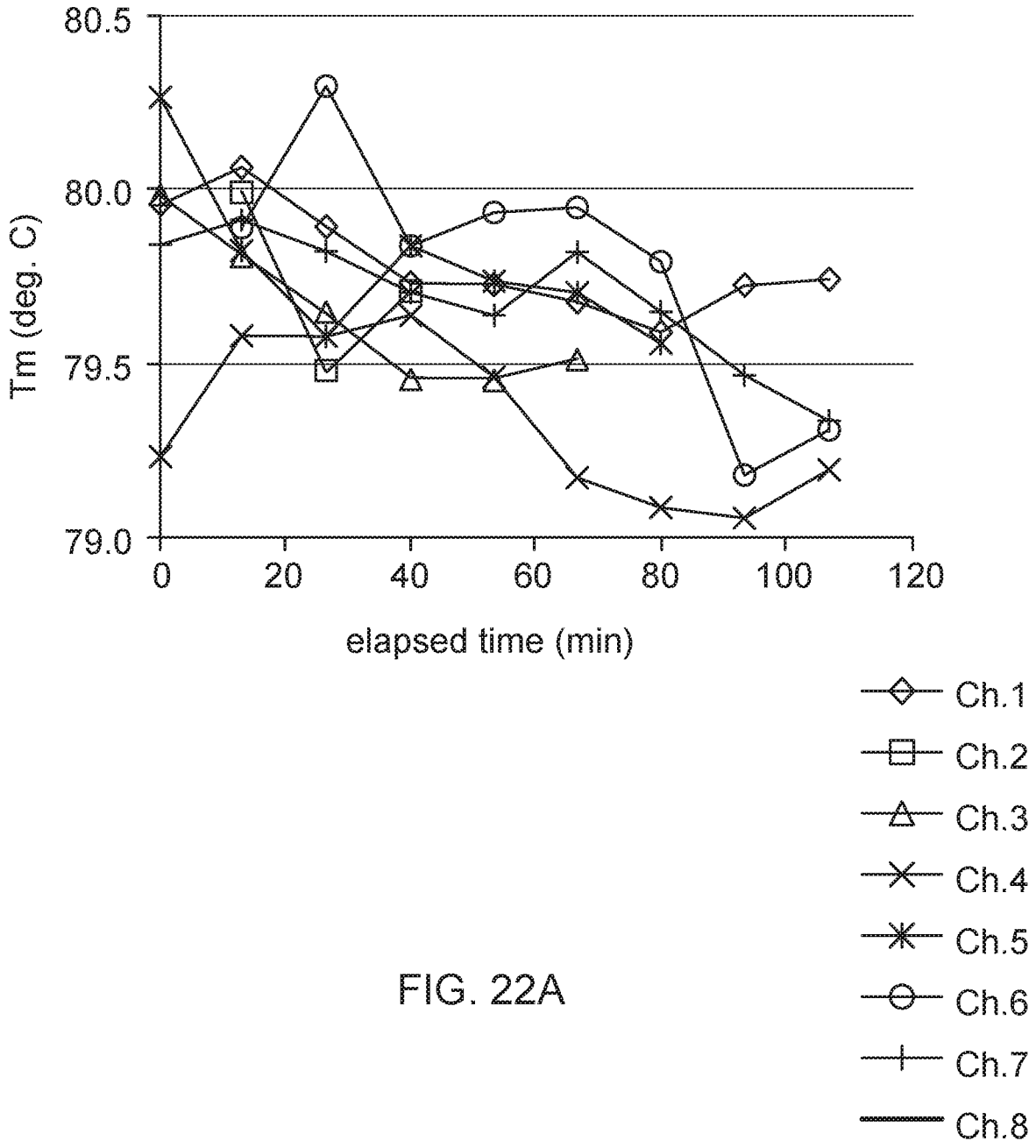
FIG. 22A-D depicts graphs of temperature vs. elapsed time.
Figure 22B:
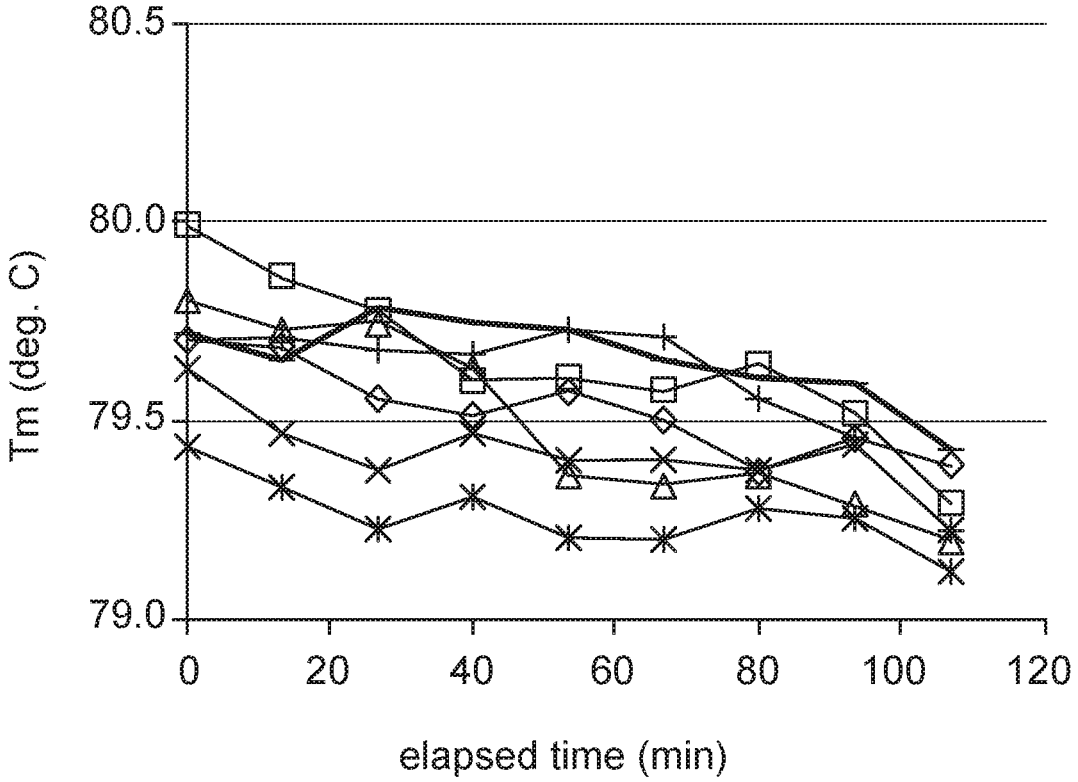
Figure 22C:
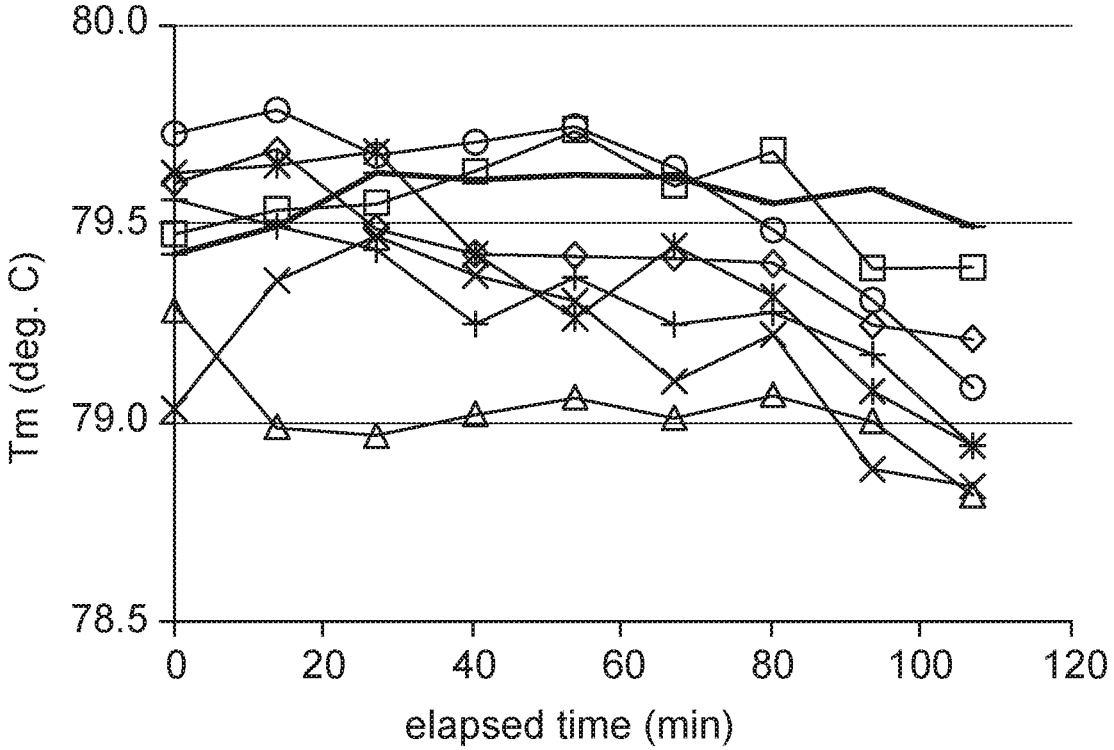
Figure 22D:
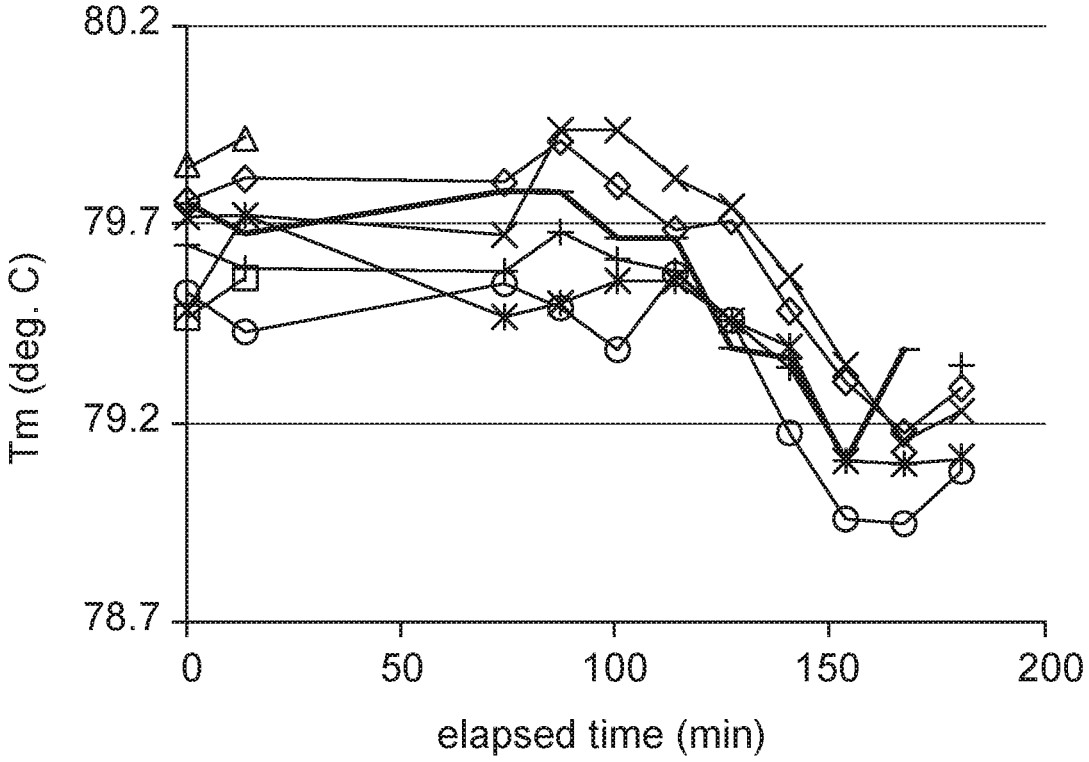
Figure 23A:
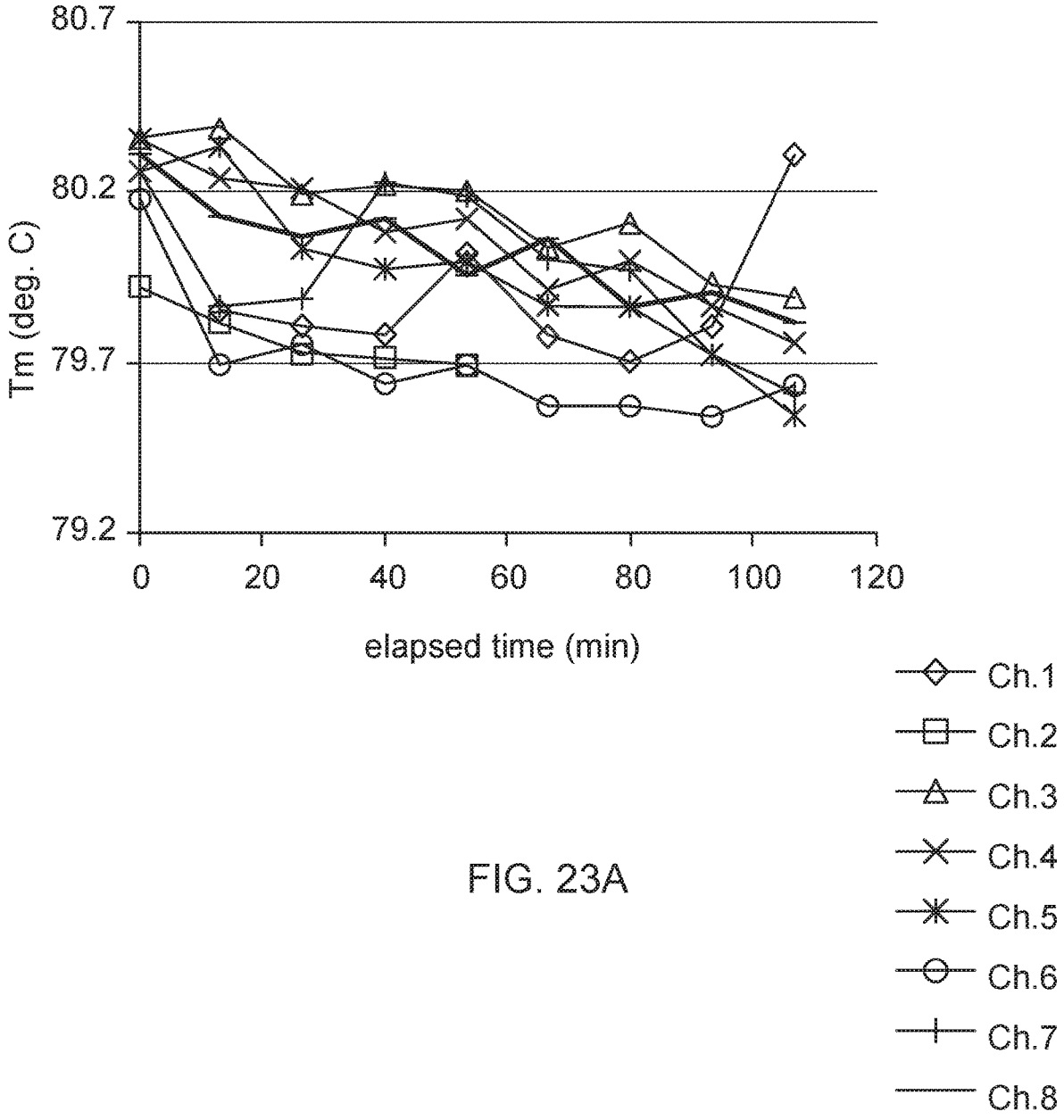
FIG. 23A-D depicts graphs of temperature vs. elapsed time.
Figure 23B:
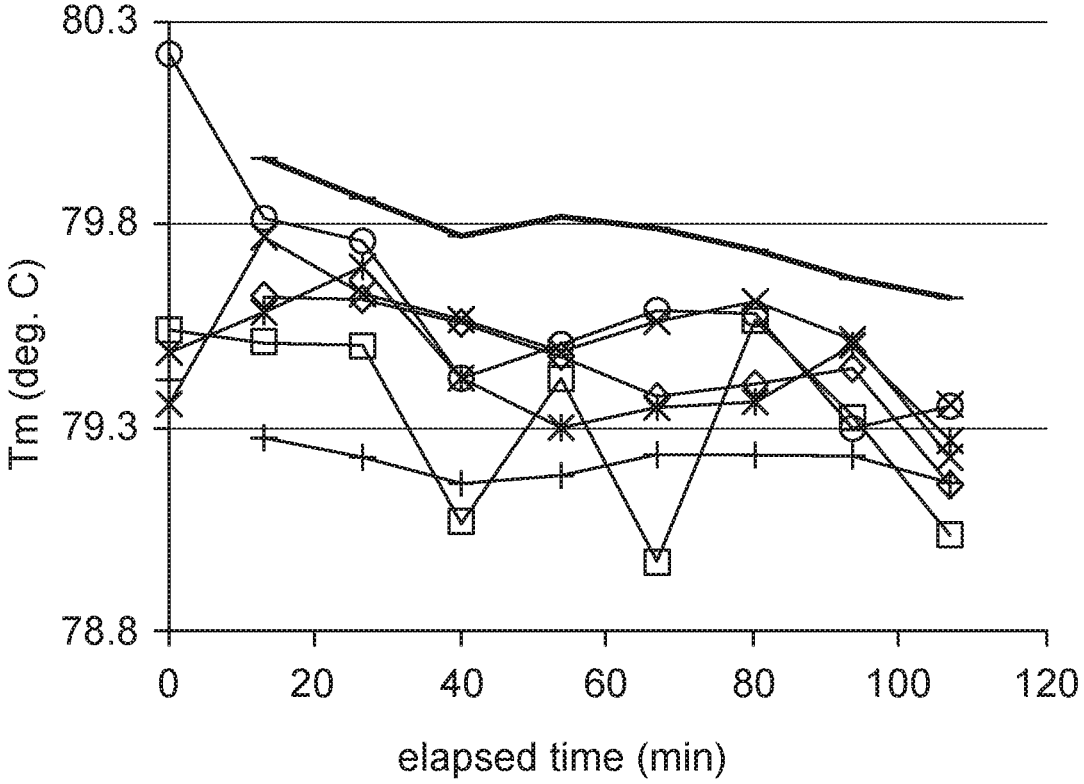
Figure 23C:
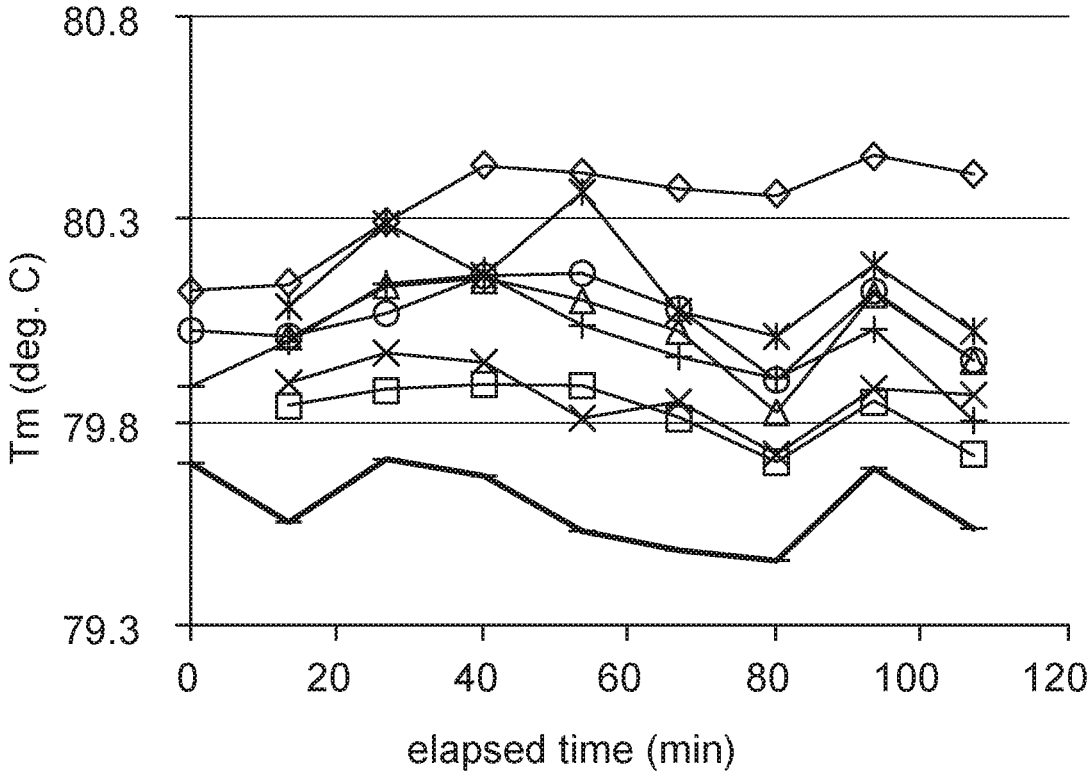
Figure 23D:
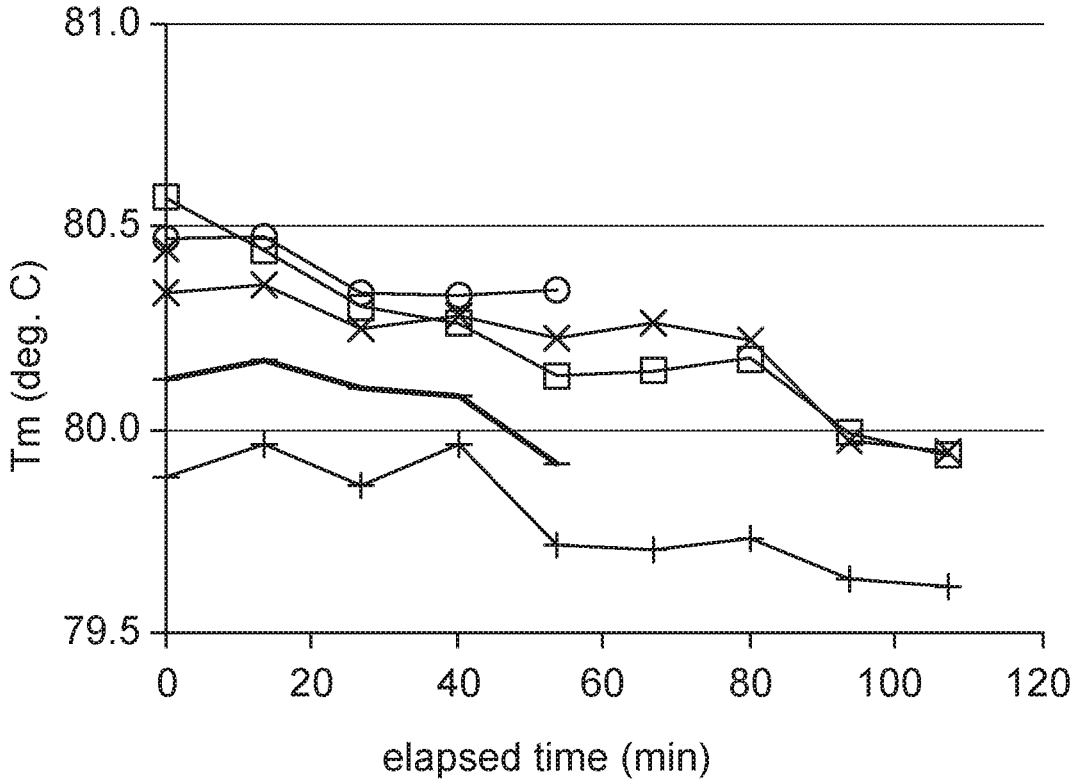

FIG. 21 depicts the distribution of Tm's by channel for the 17 melt panel for a traditional cartridge on "Baker." The distribution of Tm's was again different for the two assays. Notice the "M" shape in *3 melts 10, 12, 14, and 16 that are not present in the UCE17 melts 11, 13, 15, and 17. However, there are also trends that are present in both assays (e.g., Tm,1 is always higher than Tm,2 and Tm,7 is always higher than Tm,8). The cartridge used in the experiments reported in FIG. 21 was identified as CA-0709.

Drift in Tm

Melt temperatures were observed to trend lower throughout the panel for both external heater (FIG. 22A-D) and traditional cartridges (FIG. 23A-D). The slope (dTm/dt) was negative for 95% of the channel runs analyzed. The average slope was −0.0036° C./min, which equated to a 0.4° C. decrease in Tm between the first and last UCE17 melts. The reason for this effect was not pursued but the trend appears similar with the two different heating methods (Pt trace heater vs. external heater) and the three different temperature measurements (Pt trace sensors that cannot heat, Pt trace sensors that also heat, and external thermistor).

FIG. 22 depicts the drift in Tm of UCE17 over time with external heater cartridges on "Albert." In this figure, temperature measurements were based on the embedded platinum trace sensors. UCE17 was melted nine times. There is a clear downward trend in Tm. The cartridges used in the experiments reported in FIG. 22 were identified as CA-0435 (22A) CA-0583 (22B) CA-0576 (22C) and CA-0447 (22D).

FIG. 23 depicts the drift in Tm of UCE17 over time with traditional cartridges on "Baker." UCE17 was melted nine times. Excluding a few outliers, there is a clear downward trend in Tm. The cartridges used in the experiments reported in FIG. 23 were identified as CA-0777 (23A) CA-0776 (23B) CA-0709 (23C), and CA-0698 (23D).

Summary and Conclusion

The external heater resulted in improved uniformity of temperature as evidenced by uniform decrease in fluorescence across zone 2 during melting, sharper melt transitions, and exterior channels (1 & 8) exhibiting the same melting profile as interior ones (Ch. 2-7).

The external sensor was offset in temperature compared to the platinum trace measurements due to the cooling airflow, which lowered the sensor temperature. This has been addressed by blocking the airflow over the external heater. Regardless, using the external sensor was still a reproducible method to ramp the temperature of Zone 2. With the external heater system the zone 2 calibration process was completed more quickly because it required only a single melt. Therefore, the calibration process was more timely, straightforward, and user friendly.

Embodiments of the present invention have been fully described above with reference to the drawing figures. Although the invention has been described based upon these preferred embodiments, it would be apparent to those of skill in the art that certain modifications, variations, and alternative constructions could be made to the described embodiments within the spirit and scope of the invention.

The invention claimed is:

1. A method of heating a portion of a microfluidic device comprising:

a) providing a microfluidic device having two or more fluidic channels wherein the microfluidic device has a thermally conductive heat spreader, wherein the heat spreader is affixed to the microfluidic device such that the two or more fluidic channels are in in thermal contact with the the heat spreader, wherein the heat spreader is made of an anisotropic material or from a composite including an anisotropic thermally conductive material, and is aligned with the microfluidic device to provide uniformity of temperature between the two or more fluidic channels, wherein the highest conductance orientation of the heat spreader is aligned parallel to the plane having the two or more channels;

b) using a heating means to increase the temperature of the heat spreader to provide uniformity of temperature between the two or more fluidic channels on the microfluidic device;

c) using one or more temperature sensors embedded within the microfluidic device to determine the temperature of the two or more fluidic channels wherein the embedded sensors are passivated to prevent direct contact with samples in the two or more fluidic channels.

2. The method of claim 1, wherein the heat spreader includes one or more recesses for attachment of one or more temperature sensors.

3. The method of claim 1, further comprising insulation over at least one temperature sensor located on the heat spreader.

4. The method of claim 1, wherein the external temperature sensor is in contact with the microfluidic device or the heat spreader.

5. The method of claim 1, wherein the temperature sensor additionally controls the heating means.

6. The method of claim 1, wherein the microfluidic device further comprises an external resistive heater.

7. The method of claim 1, wherein the microfluidic device further comprises (i) an external resistive heater and an external temperature sensor attached to the heat spreader and (ii) at least one embedded temperature sensor.

8. The system of claim 7, wherein the embedded temperature sensor is a resistance temperature detector (RTD).

9. The method of claim 7, wherein the at least one embedded RTD acts as both a temperature sensor and a heater.

10. The method of claim 7, wherein the at least one embedded temperature sensor and the heat spreader are located spatially apart on the microfluidic device.

11. The method of claim 7 wherein the at least one embedded temperature sensor is at least partially beneath the heat spreader.

12. The method of claim 1, further comprising d) using a cooling means to adjust the temperature of the heat spreader or the one or more fluidic channels in response to the temperature measurements obtained in step c).

13. The method of claim 12 wherein the cooling means is a PWM fan or blower.

14. The method of claim 1 wherein the temperature sensor comprises at least one interchangeable external sensor attached to said heat spreader.

15. The method of claim 1, wherein the heat spreader is symmetric in at least one direction.

16. The method of claim 1, wherein an anisotropic thermally conductive thermal interface material connects the heat spreader to the microfluidic device.

17. The method of claim 16, wherein the anisotropic thermally conductive materials are chosen from the group consisting of: graphite, graphene, diamonds of natural or synthetic origin, or carbon nanotubes (CNTs).

18. The method of claim 16, wherein the anisotropic thermally conductive material is configured such that its orientation exhibiting the highest thermal conductance is aligned with the orientation in which of the two or more channels are disposed on the microfluidic device.

19. The method of claim 1, wherein the anisotropic thermally conductive materials are chosen from the group consisting of: graphite, graphene, diamonds of natural or synthetic origin, or carbon nanotubes (CNTs).

20. The method of claim 1, wherein the heat spreader is affixed to the microfluidic device by applying high pressure.

21. The method of claim 20, wherein the heat spreader is permanently affixed to the microfluidic device.

22. The method of claim 21 wherein the permanent bond is made with cyanoacrylate adhesive.

23. The method of claim 1, wherein the heat spreader is affixed to the microfluidic device using a material that includes nano or microparticles to increase the thermal conductance of the interconnection.

24. The method of claim 23, where the nano or microparticles are selected from the group comprising: silver, gold, aluminum and alloys thereof, copper and alloys thereof, zinc, tin, iron, CNTs, graphite, natural diamond, synthetic diamond, alumina, silica, titania, zinc oxide, tin oxide, iron oxide, and beryllium oxide.

25. The method of claim 1, additionally comprising calibrating the heating means or temperature sensor, wherein calibrating the heating means or temperature sensor comprises analyzing temperature data from at least one sensor in contact with the heat spreader and adjusting the heating means if necessary and/or calculating an offset for the sensor.

26. The method of claim 25 wherein calibrating the heating means comprises analyzing data from one or more sensor elements embedded on the microfluidic device to monitor the dynamic response of a temperature sensor that is external to the microfluidic device while being in thermal communication with the microfluidic device.

27. The method of claim 25 wherein calibrating the heating means or temperature sensor further includes introducing a control sample having a known thermal characteristics into two or more fluidic channels.

28. The method of claim 27, wherein the known thermal characteristic is a melting temperature for a nucleic acid and wherein the control sample comprises one or more of wild type DNA, amplicon, oligonucleotide, or a mixture thereof.

29. The method of claim 28, wherein the control sample comprises an ultra-conserved element (UCE).

30. The method of claim 27, wherein the control sample is introduced into one or more fluidic channels that are in the same uniform temperature zone as one or more separate fluidic channels that contain an unknown sample.

31. The method of claim 1 wherein the one or more external sensors have a thermal capacitance that is matched to that of the temperature zone on the microfluidic device.

32. The method of claim 1, wherein the heating means increases the temperature of the heat spreader from a first temperature to a second temperature, such that any nucleic acid containing samples in the two or more fluidic channels undergo denaturation due to the increasing temperature, wherein analysis of the amount of nucleic acid denaturation versus temperature comprises a nucleic acid melt analysis.

33. The method of claim 32, wherein prior to increasing the temperature of the heat spreader from a first temperature to a second temperature, any nucleic acids present in the sample undergo nucleic acid amplification on the microfluidic device.

34. The method of claim 32, wherein the nucleic acid melt analysis determines the genotype of the samples.

35. The method of claim 1, wherein the one or more embedded temperature sensors is located underneath the fluidic channels on the microfluidic device.

36. The method of claim 1, wherein the passivation materials comprise one or more of the following: glass, silicon dioxide, silicon nitride, silicon, polysilicon, parylene, polyimide, Kapton, or benzocyclobutene (BCB).

* * * * *